US009682390B2

(12) United States Patent
Ophardt et al.

(10) Patent No.: US 9,682,390 B2
(45) Date of Patent: Jun. 20, 2017

(54) DISPENSER COVER RETENTION ARRANGEMENT

(71) Applicant: OP-Hygiene IP GmbH, Niederbipp (CH)

(72) Inventors: Heiner Ophardt, Arisdorf (CH); Andrew Jones, Smithville (CA)

(73) Assignee: OP-Hygiene IP GmbH, Niederbipp (CH)

( * ) Notice: Subject to any disclaimer, the term of this patent is extended or adjusted under 35 U.S.C. 154(b) by 73 days.

(21) Appl. No.: 14/589,772

(22) Filed: Jan. 5, 2015

(65) Prior Publication Data

US 2015/0190827 A1 Jul. 9, 2015

(30) Foreign Application Priority Data

Jan. 6, 2014 (CA) ..... 2839615

(51) Int. Cl.
*A47K 5/12* (2006.01)
*B05B 11/00* (2006.01)
*B67D 7/06* (2010.01)

(52) U.S. Cl.
CPC ..... *B05B 11/0037* (2013.01); *A47K 5/12* (2013.01); *A47K 5/1211* (2013.01); (Continued)

(58) Field of Classification Search
CPC ... B67D 7/06; B05B 11/0005; B05B 11/0037; B05B 11/0054; A47K 5/12; A47K 5/1211; A47K 5/1202; A47K 5/1208
(Continued)

(56) References Cited

U.S. PATENT DOCUMENTS 2,747,388 A * 5/1956 Dolar ..... A47J 47/02 217/57
5,183,182 A * 2/1993 Comstock ..... A47K 5/12 222/129

(Continued)

FOREIGN PATENT DOCUMENTS

EP 0341757 11/1989

*Primary Examiner* — Paul R Durand
*Assistant Examiner* — Andrew P Bainbridge
(74) *Attorney, Agent, or Firm* — Thorpe North & Western LLP

(57) ABSTRACT

A dispenser for a consumable product having a backplate for mounting to a wall and a cover member pivotably mounted to the backplate for relative pivotal movement between a closed position and an open position. The cover member carrying a journal rod disposed about an axis. A movable member coupled to the backplate for relative vertical sliding movement between a lower first position and a higher second position. The backplate carrying at a lower end of the backplate a complementary second journal bearing portion open downwardly. The second bearing portion slidable vertically upwardly away from the first bearing portion in movement of the support member from the first position to the second position to permit, when the movable member is in the second position, the coupling and uncoupling of the cover member from the backplate and wherein with the movable member in the second position with the journal rod engaged with the first journal portion of the backplate, the backplate engages the journal rod to support the cover member on the backplate.

20 Claims, 23 Drawing Sheets

(52) U.S. Cl.
CPC ..... *B05B 11/0005* (2013.01); *B05B 11/0054* (2013.01); *B67D 7/06* (2013.01)

(58) Field of Classification Search
USPC ..... 222/153.09, 153.14, 181.3, 182, 183
See application file for complete search history.

(56) References Cited

U.S. PATENT DOCUMENTS 5,632,418 A * 5/1997 Brown ..... A47K 5/1202 222/153.09
5,836,482 A 11/1998 Ophardt et al.
6,131,773 A * 10/2000 Wade ..... A47K 5/1215 222/153.02
6,152,330 A 11/2000 Polan
6,325,245 B1 * 12/2001 Matthews ..... A47K 5/12 222/181.1
6,877,642 B1 * 4/2005 Maddox ..... A47K 5/1208 222/105
7,028,861 B2 * 4/2006 Sayers ..... A47K 5/1217 222/1
7,044,328 B1 5/2006 Ciavarella
7,232,045 B2 6/2007 Ophardt et al.
7,637,391 B2 * 12/2009 Rosenkranz ..... A47K 5/12 222/181.3
7,748,573 B2 * 7/2010 Anhuf ..... A47K 5/12 222/180
8,251,253 B1 * 8/2012 Cleghorn ..... H01H 9/02 174/50
8,413,852 B2 4/2013 Ophardt et al.
2002/0008369 A1 * 1/2002 Inoue ..... B60R 21/205 280/728.2
2008/0054016 A1 * 3/2008 Rosenkranz ..... A47K 5/12 222/52
2008/0110936 A1 * 5/2008 Ophardt ..... B05B 11/3014 222/321.8
2012/0080452 A1 * 4/2012 Boshuizen ..... G01F 11/00 222/181.3

* cited by examiner

DISPENSER COVER RETENTION ARRANGEMENT

SCOPE OF THE INVENTION

This invention relates to dispensers for consumable products and, more particularly, to arrangements for removably mounting a cover member to the dispensers.

BACKGROUND OF THE INVENTION

Dispensers and particularly fluid dispensers are known to have a backplate for mounting to a wall or other support structure and a cover member pivotally mounted to the backplate for relative movement between a closed position and an open position and in which a consumable product is disposed in a cavity between the backplate and the cover member. The cover member may be moved to an open position to replace the consumable product.

The present inventors have appreciated that previously known dispensers and notably soap dispensers suffer the disadvantage that the cover member cannot readily be applied or removed as, for example, for replacement by the same or a different cover member.

SUMMARY OF THE INVENTION

To at least partially overcome these disadvantages of previously known devices, the present invention provides an arrangement for removably coupling of the cover member to a dispenser.

In one aspect, the present invention provides a dispenser for a consumable product having a backplate for mounting to a wall and a cover member pivotably mounted to the backplate for relative movement between a closed position and an open position;

the cover member carrying a journal rod disposed about an axis;

a movable member coupled to the backplate for relative movement between a first position and a second position, the backplate carrying a first journal bearing portion and the movable member carrying a complementary second journal bearing portion;

with the movable member in the first position:

a. the first journal portion and the second journal portion mate with each other to form a journal bearing with a bore for receiving therein the journal rod, b. when the journal rod is received in the bore, the bore prevents removal of the journal rod from the bore, and c. when the journal rod is received in the bore, the bore engages the journal rod for pivoting of the cover member about the axis relative the backplate between the open position and the closed position;

with the support member in the second position the first journal portion and the second journal portion are spaced from each other:

a. to permit the journal rod to be inserted into the journal bore to engage the cover member with the backplate, and b. to permit the journal rod to be removed from the journal bore permitting the cover member to disengage from the backplate.

The movable member preferably acts as a mount for removably mounting the consumable product within a cavity between the cover member and the backplate. Opening of the cover member provides access to the movable member to replace the consumable product when depleted. Preferably, the consumable product is provided as a replaceable cartridge assembly which is removably coupled to the movable support member. Preferably, each of the cover member and support member may be removed and replaced by a replacement cover member or support member having the same or a different configuration. The consumable product may comprise fluid as, for example, hand cleaning liquid in a bottle or paper towels for drying a person's hands.

BRIEF DESCRIPTION OF THE DRAWINGS

Further aspects and advantages of the invention will become apparent from the following description taken together with the accompanying drawings in which.

DETAILED DESCRIPTION OF THE DRAWINGS

Figure 1:
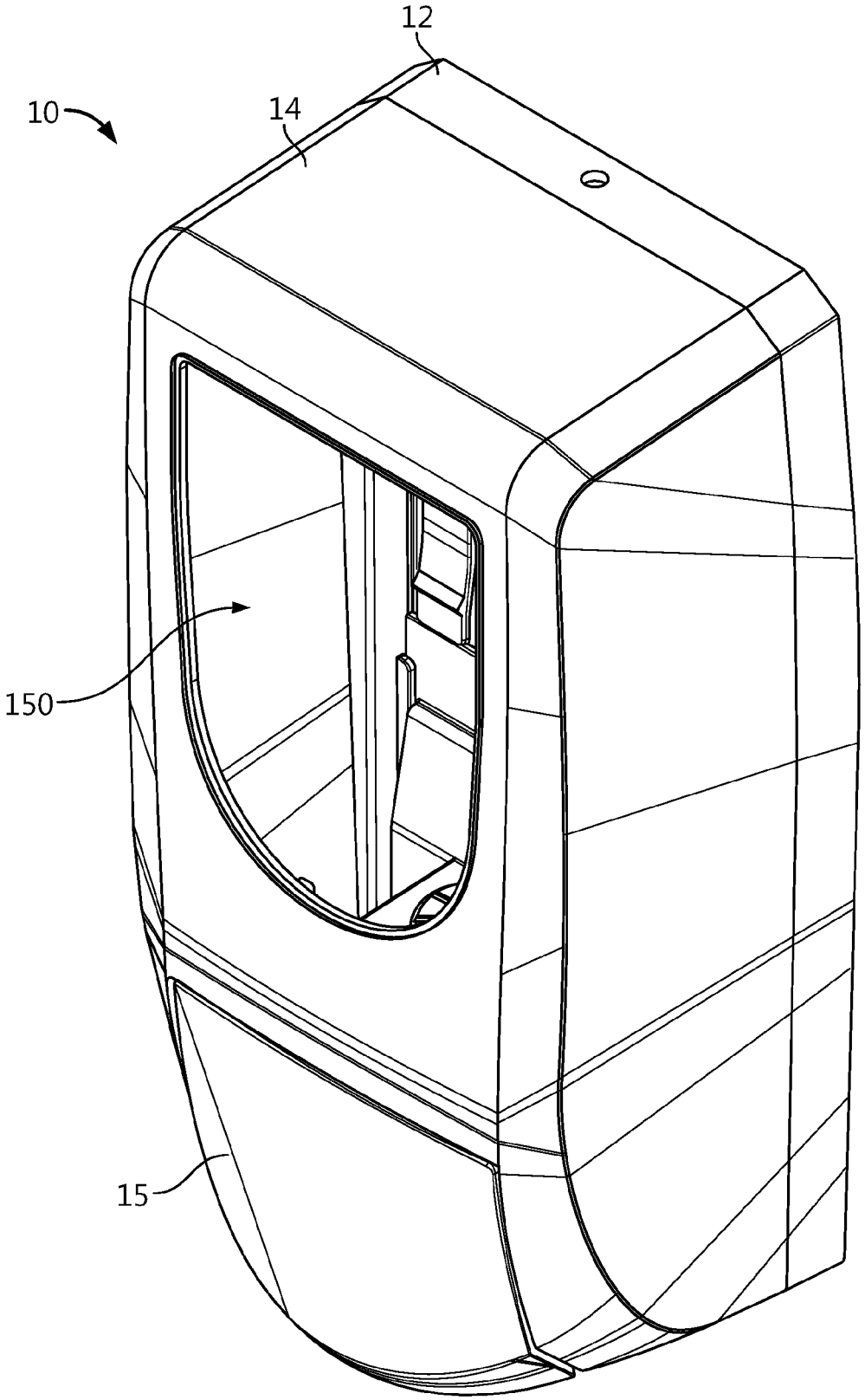
FIG. 1 is a perspective view of an assembled dispenser in a closed position in accordance with a first embodiment of the invention.
Figure 2:
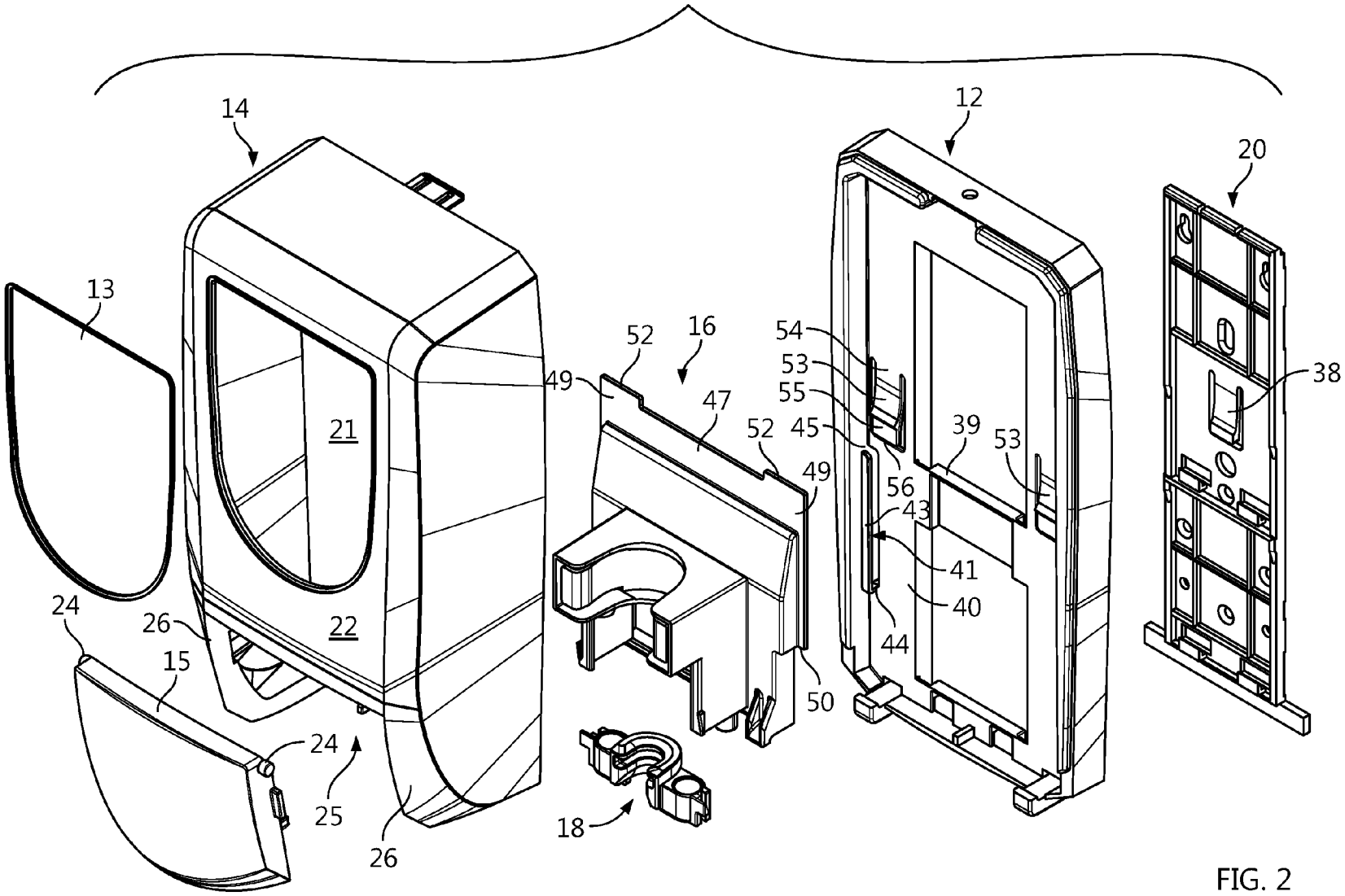
FIG. 2 is an exploded pictorial view of the dispenser of FIG. 1.

FIG. 1 which illustrates a first preferred embodiment of a dispenser 10 shown in an assembled condition. FIG. 2 is an exploded pictorial view of the dispenser 10 of FIG. 1 showing the individual components that comprise a dispenser 10, namely, a backplate 12, a cover member 14, a movable support plate 16, an actuator member 18, a wall plate 20, a transparent plastic window member 13 for the cover member 14 and a lever 15.

Figure 3:
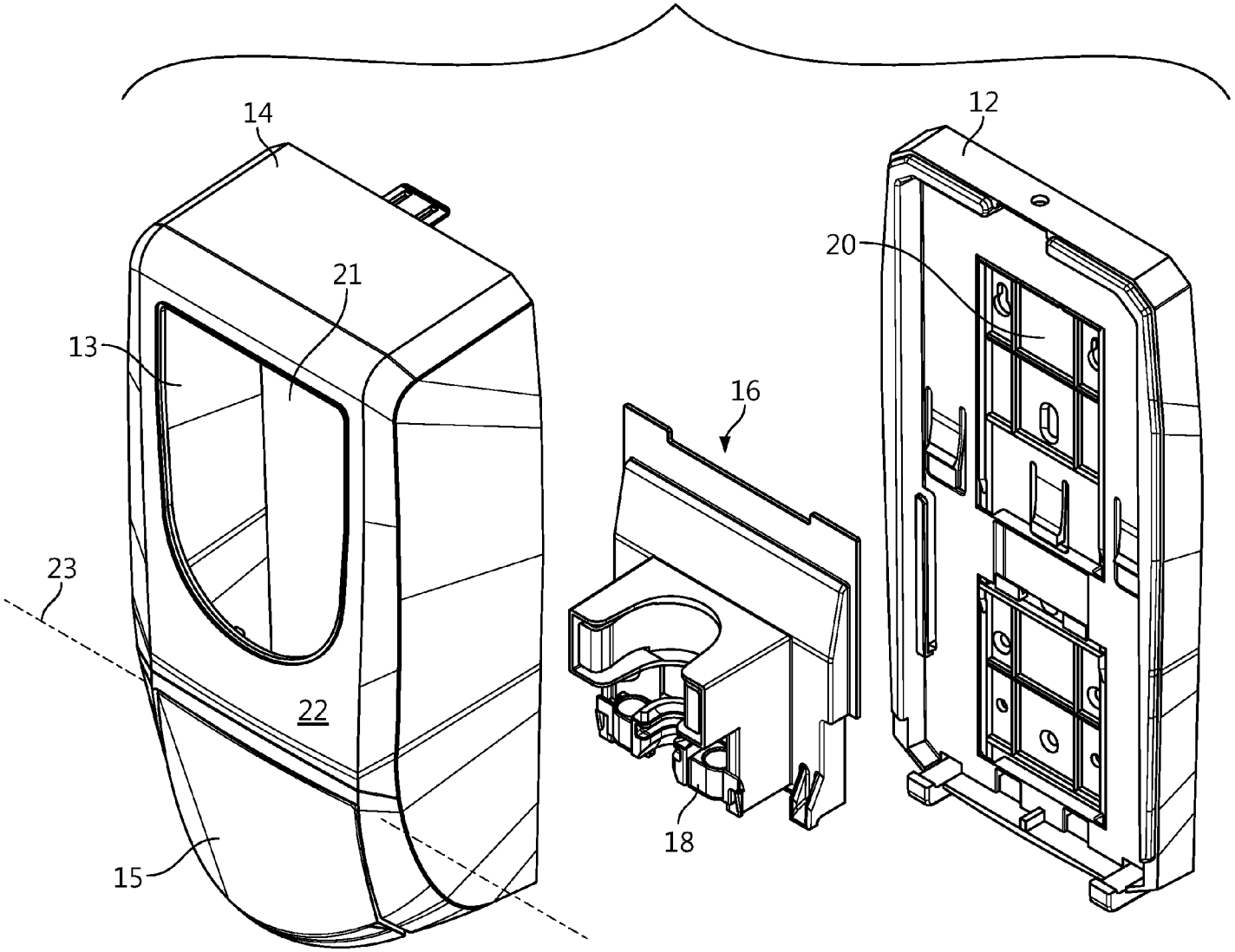
FIG. 3 is an exploded pictorial view of the dispenser of FIG. 1 with some of the components shown in FIG. 2 assembled.

Referring to the exploded view in FIG. 3, the cover member 14 is shown with the window member 13 secured within a window opening 21 in a front surface 22 of the cover member 14 and the lever 15 pivotally mounted to the cover member 14 for pivoting about a horizontal axis 23. As can be seen in FIG. 2, the lever 15 carries two stub axles 24 on either side. The lever 15 is sized to be received in a lever opening 25 provided on the cover member 14 below the front surface 22 of the cover 14 and between two side walls 26 of the cover 14. The stub axles 24 are to be engaged within blind journaling bores (not shown) on each of the side walls 26.

Figure 4:
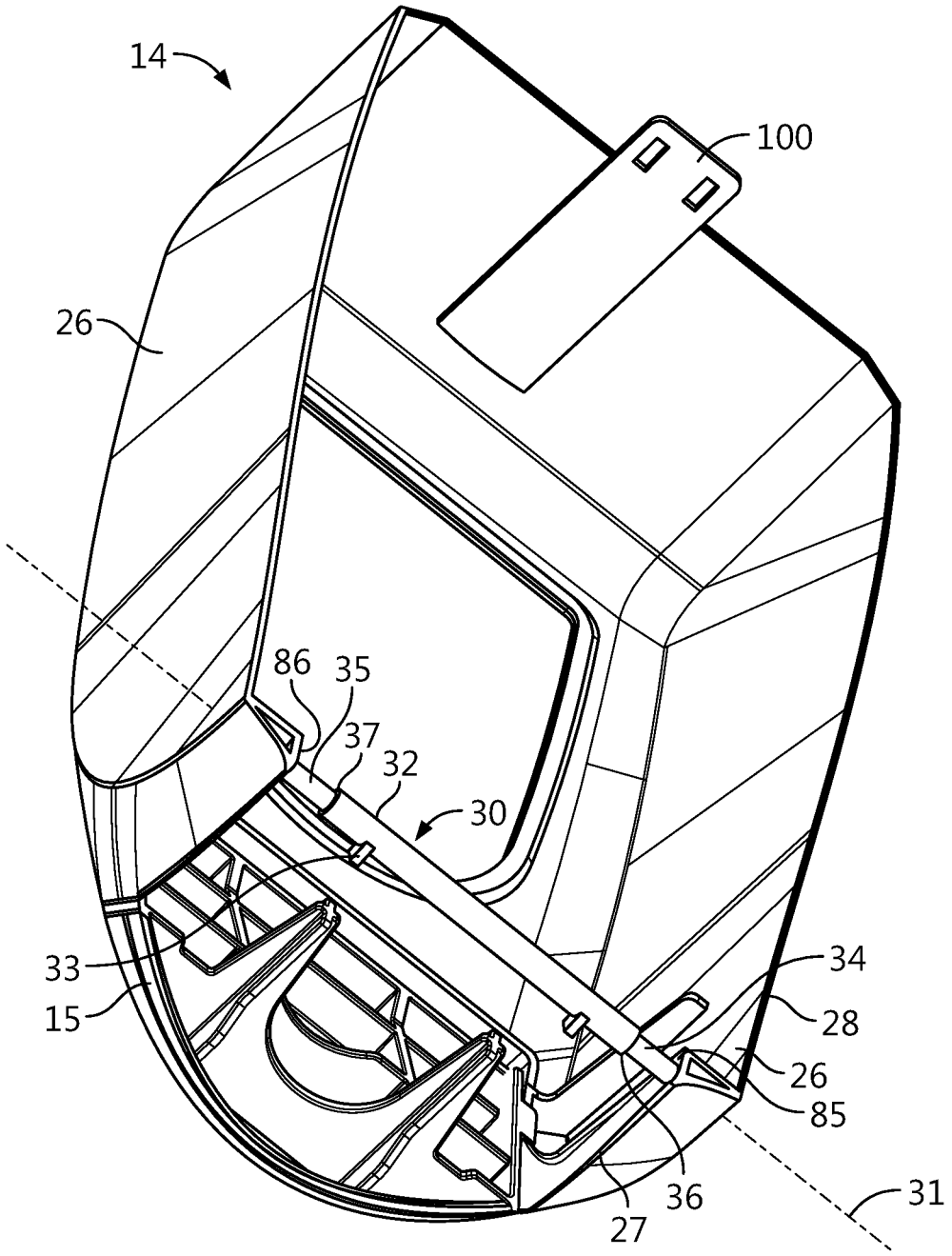
FIG. 4 is a pictorial rear view of the assembled cover shown in FIG. 3.

FIG. 4 is a pictorial rear view of the cover member 14 as shown in FIG. 3. Extending between the side walls 26 proximate the juncture of a lower end 27 of the cover member 14 and a rear 28 of the cover member 14 is a journal rod 30 extending about a rod axis 31. The journal rod 30 has a cylindrical central rod portion 32 carrying two radially outwardly extending stop lugs 33. Laterally outwardly of the central rod portion 32, the journal rod 30 includes a cylindrical left rod portion 34 and a cylindrical right rod portion 35, each of which has a reduced diameter compared to the central rod portion 32 such that the journal rod 30 is stepped between the center rod portion 32 and the left rod portion 34 at a left shoulder 36 between the central rod portion 32 and the left rod portion 34 and at a right shoulder 37 between the central rod portion 32 and the right rod portion 35.

Referring to FIG. 2, the wall plate 20 is adapted to be secured to a wall or other support member (not shown). With the wall plate 20 secured to a wall (not shown), the backplate 12 may be removably secured to the wall plate 20 by being slid vertically downwardly onto the wall plate 20 with a resilient catch member 38 on the wall plate 20 to engage an upwardly directed catch surface 39 on the backplate 12 to prevent removal of the backplate 12 from the wall plate 20 unless the catch member 38 is manually depressed. The assembled backplate 12 and wall plate 20 is shown in FIG. 3.

Figure 5:
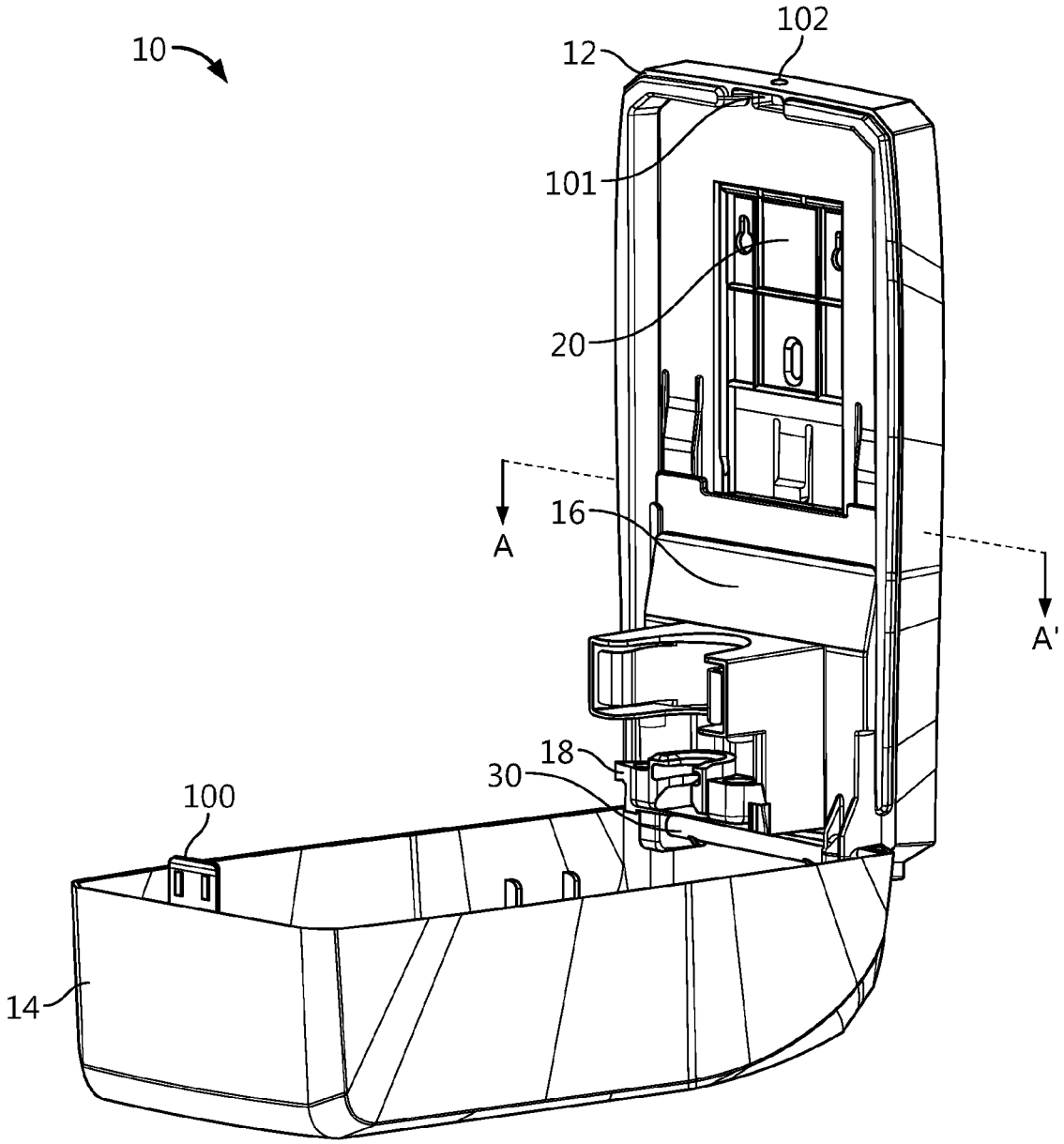
FIG. 5 is a pictorial view of the dispenser of FIG. 1 in an open condition with the support member in the lower second position.
Figure 6:
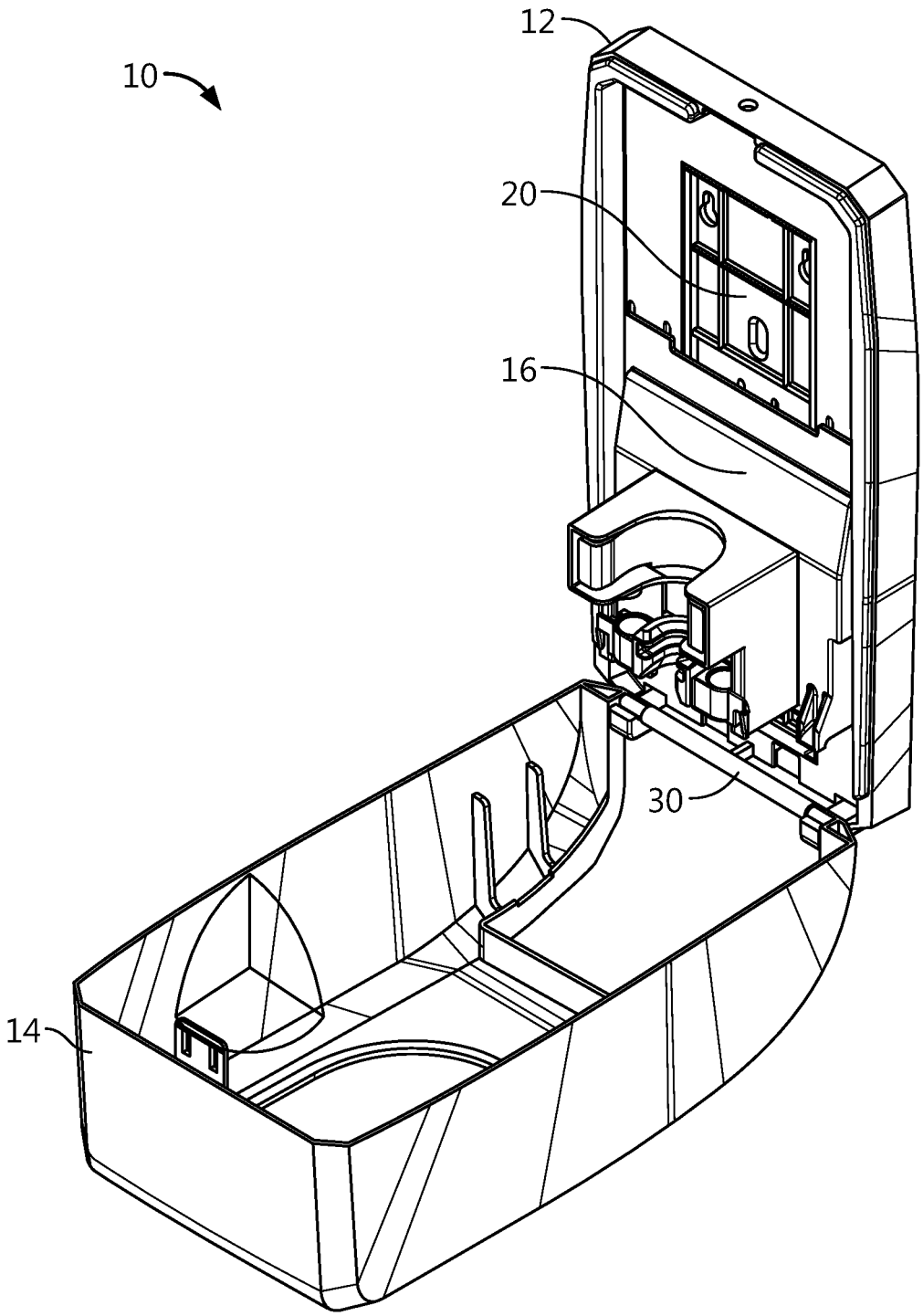
FIG. 6 is a pictorial view the same as FIG. 5, however, with the support member in the upper second position.

The movable member 16 (also referred to as the movable support member 16 and the support member 16) is removably coupled to the backplate 12, more particularly, vertically slidably engageable with the backplate 12 to be movable as between a lower first position shown in FIG. 5 (as well as FIGS. 8, 9 and 13) and an upper second position shown in FIG. 6 (as well as FIGS. 7, 10, 11, 14, 15 and 16).

As can be seen in FIG. 2, the backplate 12 has a forwardly directed planar slide surface 40. On each lateral side of the slide surface 40, the backplate 12 carries a channelway 41. Each channelway 41 extends vertically between an open upper end 45 and a closed lower end 44. As can best be seen in the horizontal cross-sectional view of FIG. 12, each channelway 41 is defined on the support members 16 between an outside side wall 42, the slide surface 40 and a vertically extending thin forward flange 43 so as to open laterally inwardly.

Figure 18:
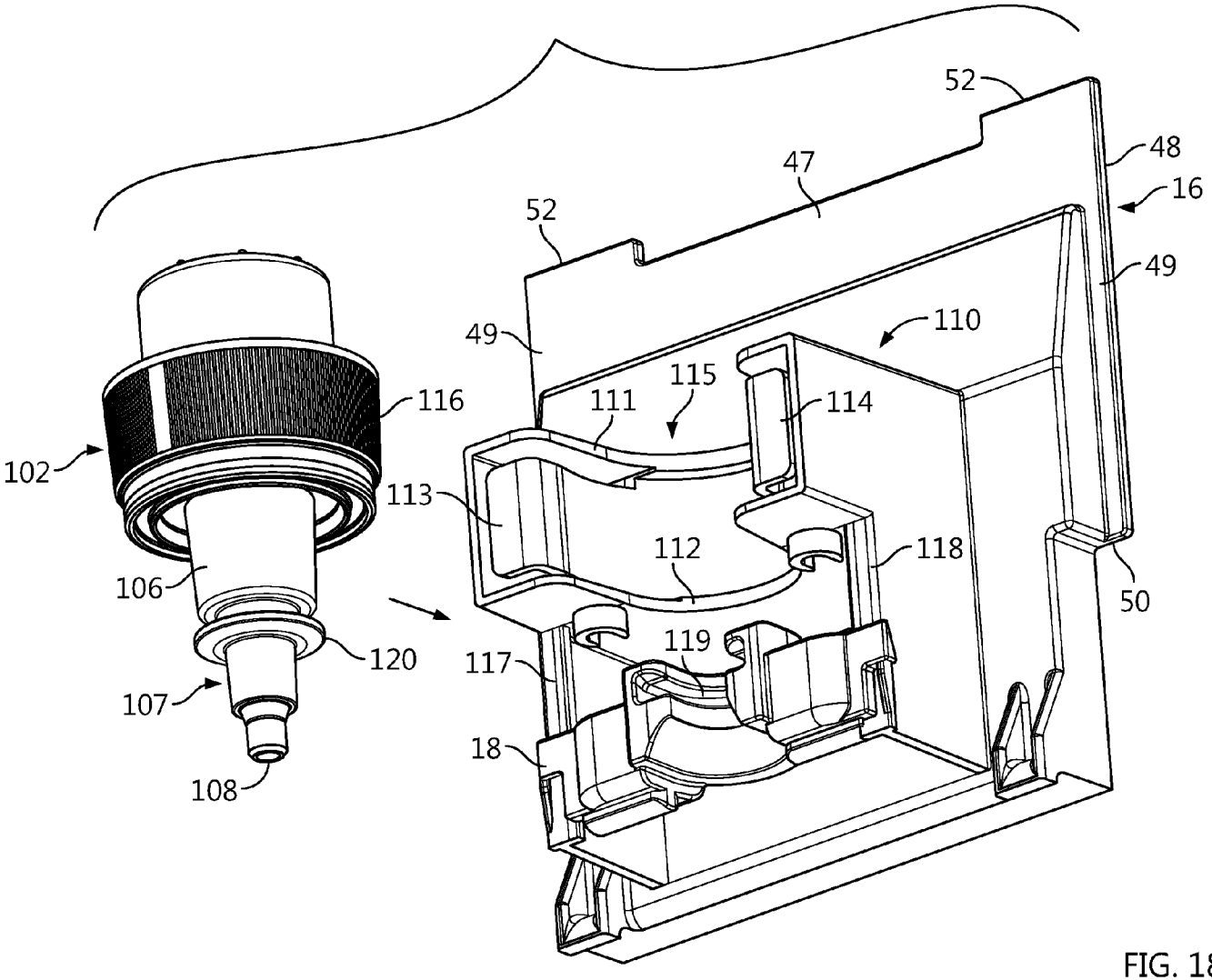
FIG. 18 is an exploded schematic pictorial view showing the actuator plate assembled on the support member as in FIG. 3 with a pump assembly ready for coupling.

As best seen on FIG. 18, the support member 16 includes a slide member 47 presenting a planar rear surface 48 adapted to engage and slide on the slide surface 40. The slide member 47 has on each of its left and right sides a laterally extending slide flange 49 sized to be closely received within the respective left and right channelways 41. Each of the slide flanges 49 carry at a lower end a stop shoulder 50 for engagement with the lower end 44 of the channelway 41 to stop downward sliding of the support member 16 relative to the backplate 12 by engagement with the lower end 44 of the channelway 41. At an upper end of each of the slide flanges 49 carry an upwardly directed catch shoulder 52. The backplate 12 carries a pair of left and right finger-like catch members 53. Each catch member 53 is secured to the backplate 12 at an upper end 54 and extends forwardly to a distal catch end 55 with a downwardly facing shoulder 56. Each catch member 53 at its upper end 54 has its forward surface disposed in the plane of the slide surface 40 and as the catch member 53 extends downwardly to its distal catch end 55, the catch member 53 extends forwardly such that at the distal catch end 55, the downwardly directed shoulder 56 is disposed forwardly of the slide surface 40. The catch member 53 is resilient and biased to assume an unbiased condition as shown in FIG. 2 with the shoulder 56 forward of the slide surface 40. The catch member 53 is deflectable rearwardly such that the entirety of the catch member 53 may be disposed in or rearwardly of the plane of the slide surface 40 and, when so deflected, is biased under its inherent bias to return to its unbiased condition.

The support member 16 may be manually applied to and removed from engagement with the backplate 12. With the support member 16 located relative to the backplate 12 with the rear surface 48 of the slide member 47 located to overlie the slide surface 40 with the stop shoulders 50 of the slide flanges 49 located above the upper end 45 of the channelways 41, the support member 16 may then be slid vertically downwardly with each of the left and right slide flanges 49 received in the respective left and right channelways 41 until the stop shoulders 50 of the slide member 47 engage the lower ends 44 of the channelways 41. During the initial engagement of the support member 16 to the backplate 12, a rearwardly directed force is applied so as to rearwardly depress the catch members 53 to slide rearwardly behind the slide member 47. On the support member 16 being slid downwardly such that the stop shoulders 50 engage the lower end 44 of the channelways 41, the catch shoulder 52 on each side of the slide member 47 will come to be disposed at a height below the height of the shoulder 56 of the digital catch end 55 of each catch member 53. On each catch shoulder 52 of the slide member 47 moving vertically downwardly past the shoulder 56 of the slide member 47, under the inherent bias of the catch member 53, each catch member 53 will move to an unbiased condition with the digital catch end 55 carrying the shoulder 56 moving forwardly so as to be disposed vertically above the catch shoulder 52 of the slide member 47 in a locked condition in which vertical upward sliding of the support member 16 relative to the backplate 12 is prevented by reason that the shoulder 56 on the digital catch end 55 of each catch member 53 is in vertical opposition to and opposes upward movement of the catch shoulder 52 of the slide member 47 of the support member 16. When the support member 16 has its stop shoulders 50 engaged with the lower end 44 of the channelways, the support member 16 is in a lower, first position in which the support member 16 is in the locked condition relative to the backplate 21. To remove the support member 16 from the backplate 21, the two catch members 53 are manually urged rearwardly sufficiently that the shoulder 56 of each digital catch end 55 is moved to be flush with or below the slide surface 40 permitting the catch shoulder 52 of each slide member 47 to slide upwardly past the catch members 53.

The support member 16 can be readily coupled and uncoupled to the backplate member 12 with relative sliding vertically and applying manual rearward pressure on the catch members 53.

Figure 7:
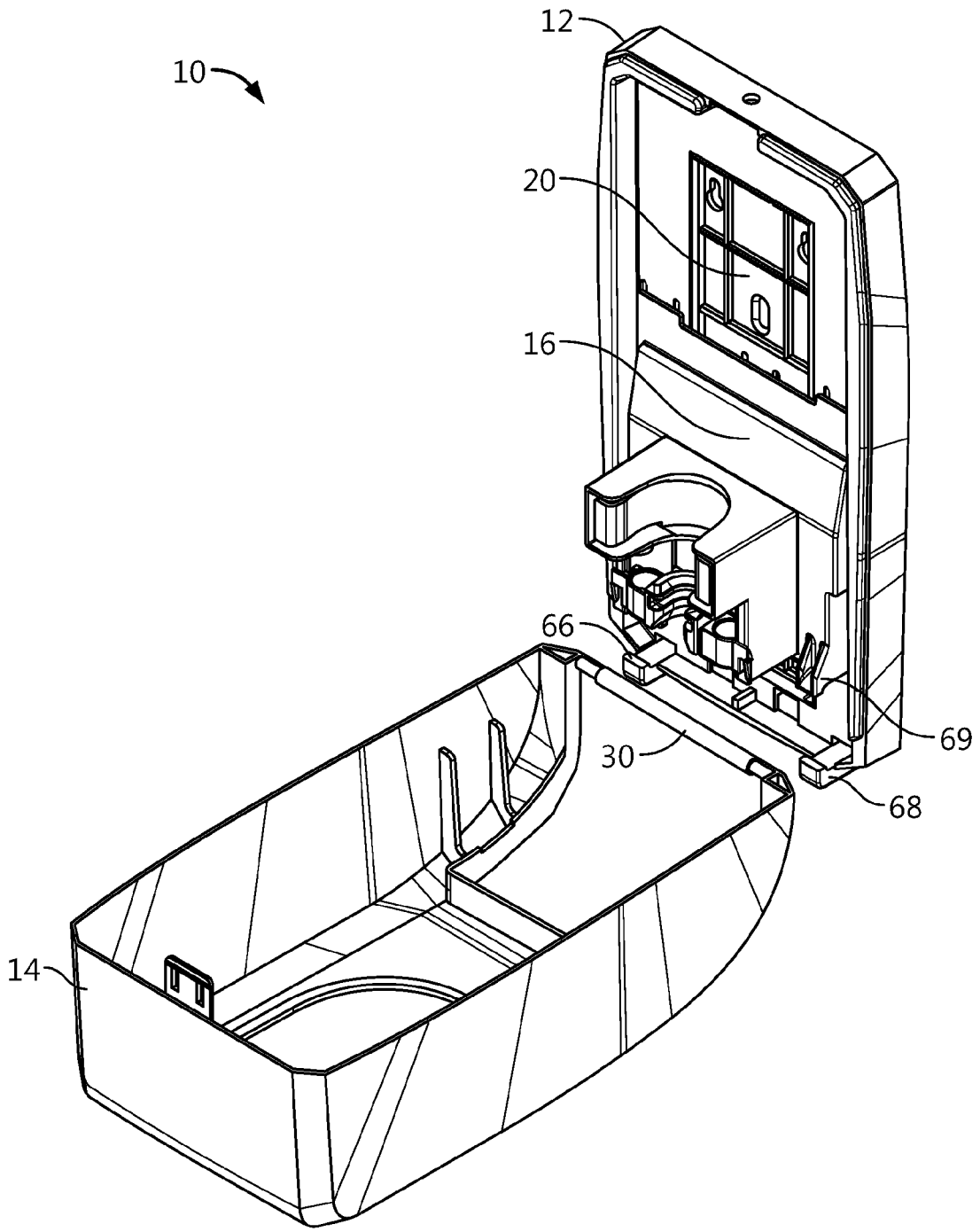
FIG. 7 is a pictorial view the same as FIG. 6, however, with the cover member in a position vertically above and horizontally forward of the position of the cover member in FIG. 6.
Figure 13:
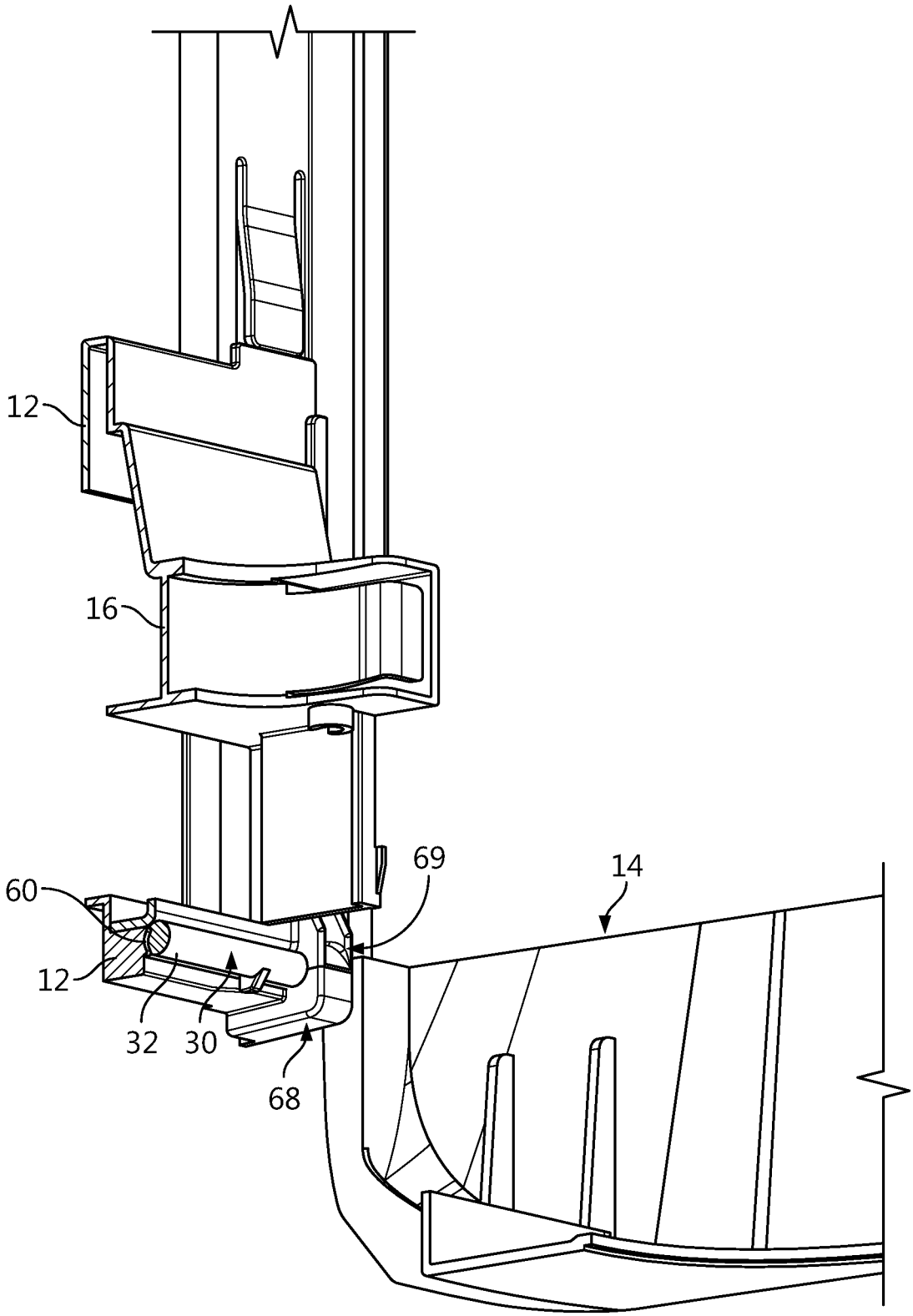
FIG. 13 is a partial pictorial view of the dispenser of FIG. 5 in an open position as cross-sectioned through a vertical center plane as seen from the left-hand side and with the support member in a lower, first position.

FIG. 5 as well as FIG. 13 illustrate a condition also shown in FIG. 13 with the support plate 16 in the lower first position in a locked condition to the backplate 12 and with the cover member 14 having its journal rod 30 received between the support flange 16 and the backplate 12 for pivoting about the axis 31 of the journal rod 30 between the open position shown in FIG. 5 and the closed position shown in FIG. 1. From the condition of FIG. 5, the support member 16 may be manually moved to the second, raised position to assume the condition of FIG. 6 with the cover member 14 remaining engaged with the backplate 12. From the position of FIG. 6, the cover member 14 may be moved vertically and then horizontally forwardly to the disengaged condition of FIG. 7. FIG. 7 shows the backplate 12 and support member 16 in an upper raised position and the cover member disengaged from the backplate but located with its support rod 30 disposed forwardly of the backplate 12. The cover member 14 is engageable and disengageable from the backplate 12 when the support member 16 is in the raised second position, as illustrated in FIGS. 6 and 7 as well as FIGS. 14, 15 and 16.

Figure 8:
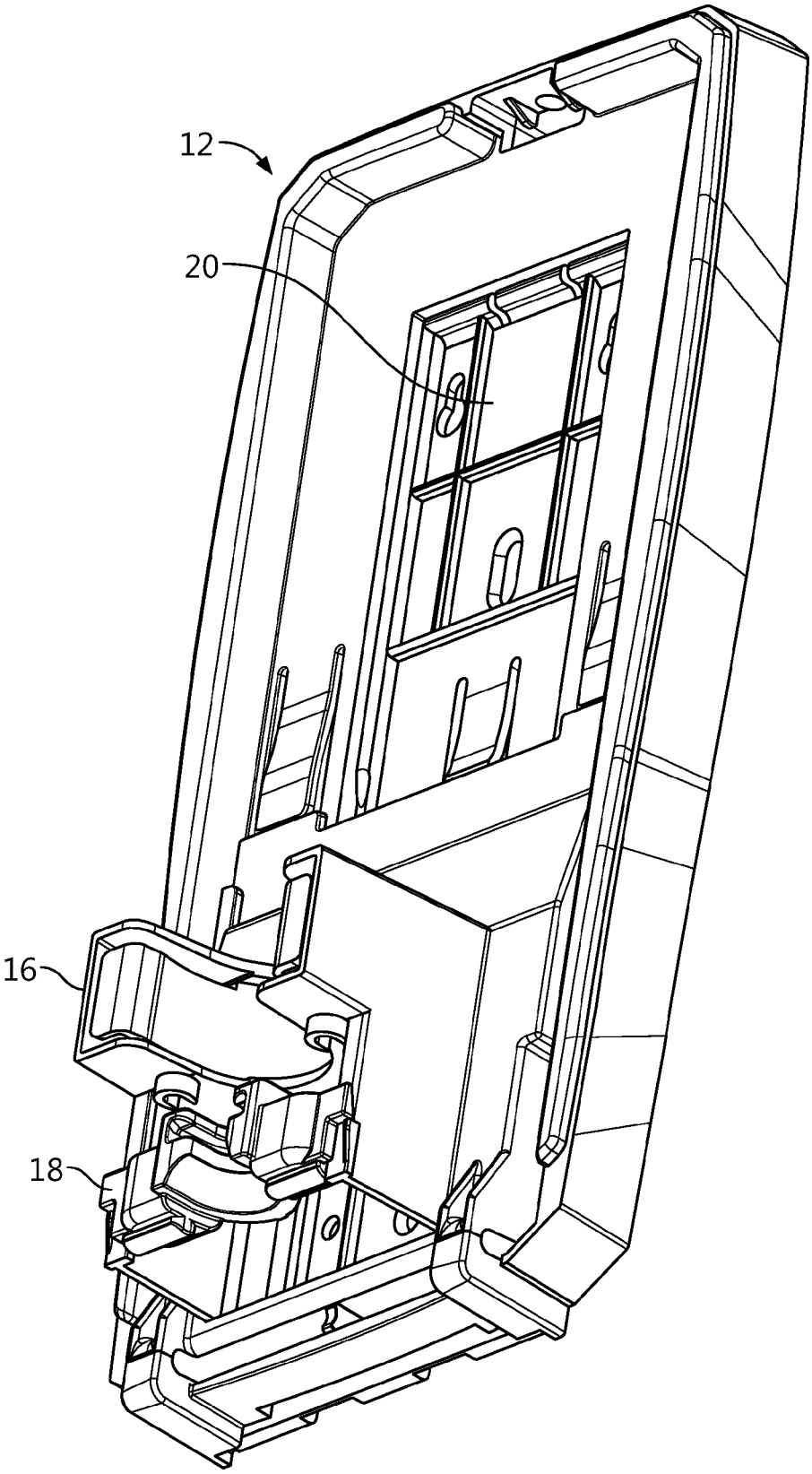
FIG. 8 is a pictorial view of the wall plate, backplate, support member and actuator member of FIG. 2 assembled with the support member in a lower first position.
Figure 9:
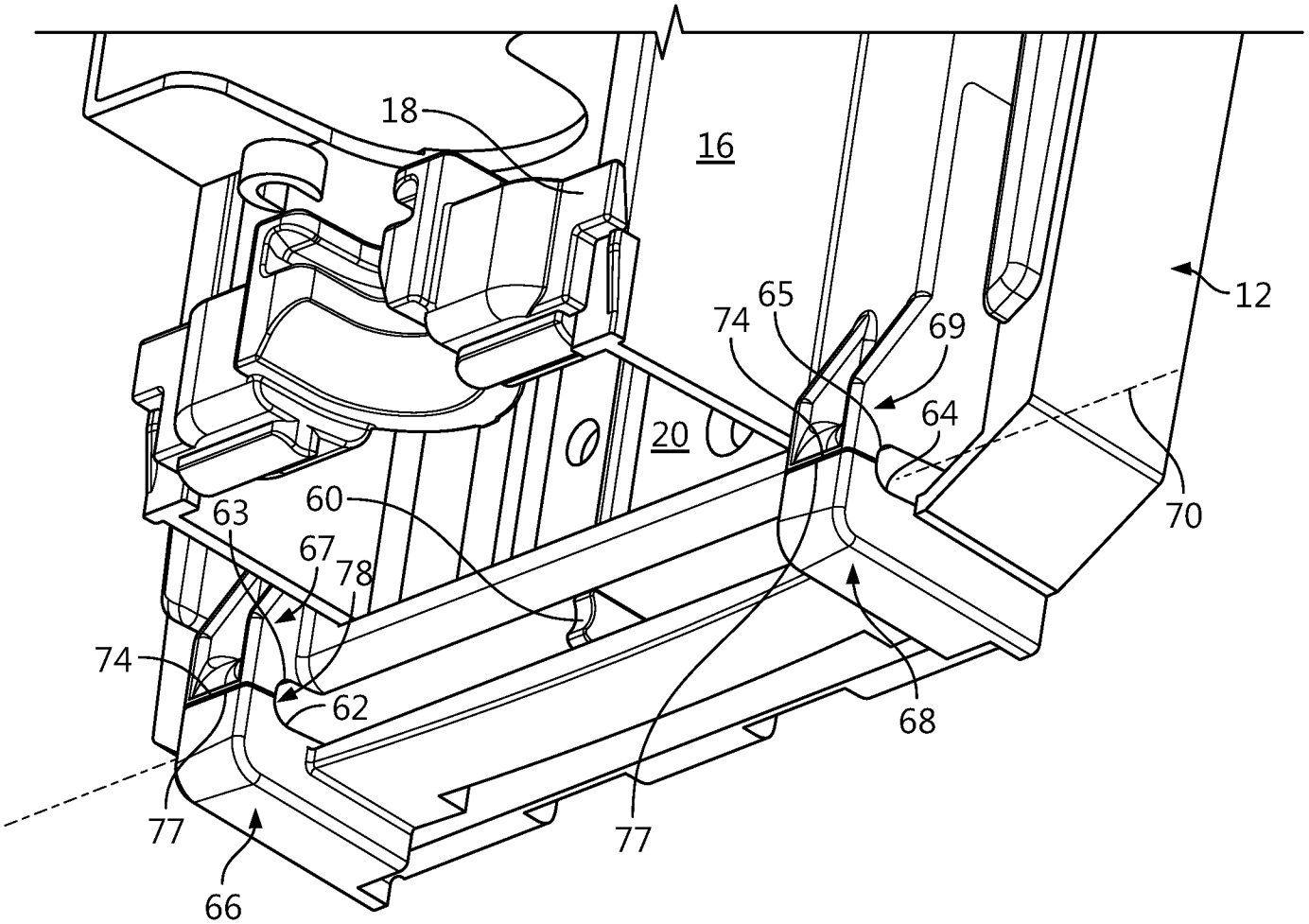
FIG. 9 is an enlarged view of lower portions of FIG. 8.
Figure 10:
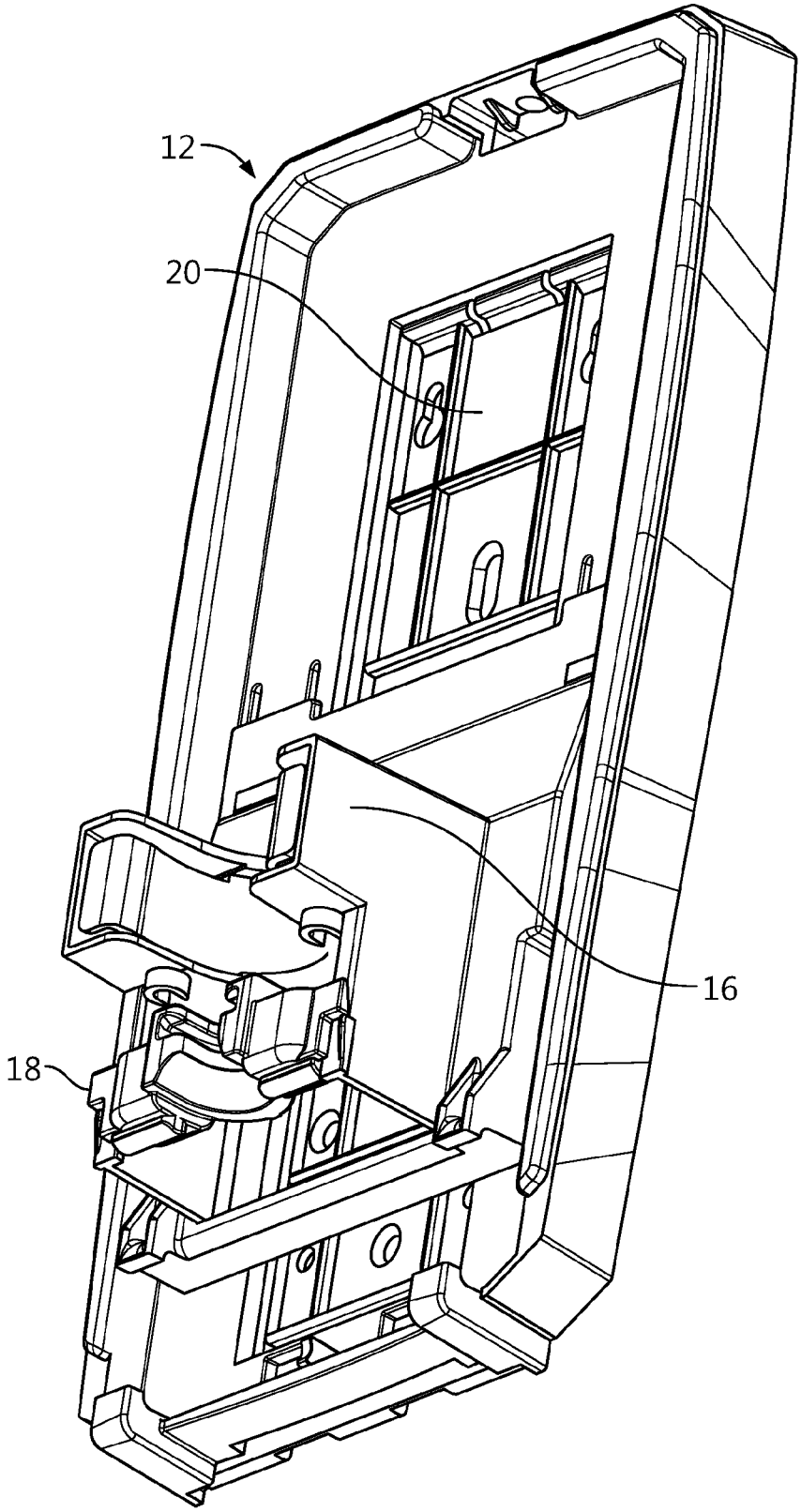
FIG. 10 is a view the same as FIG. 8, however, with the support member in an upper second position.
Figure 11:
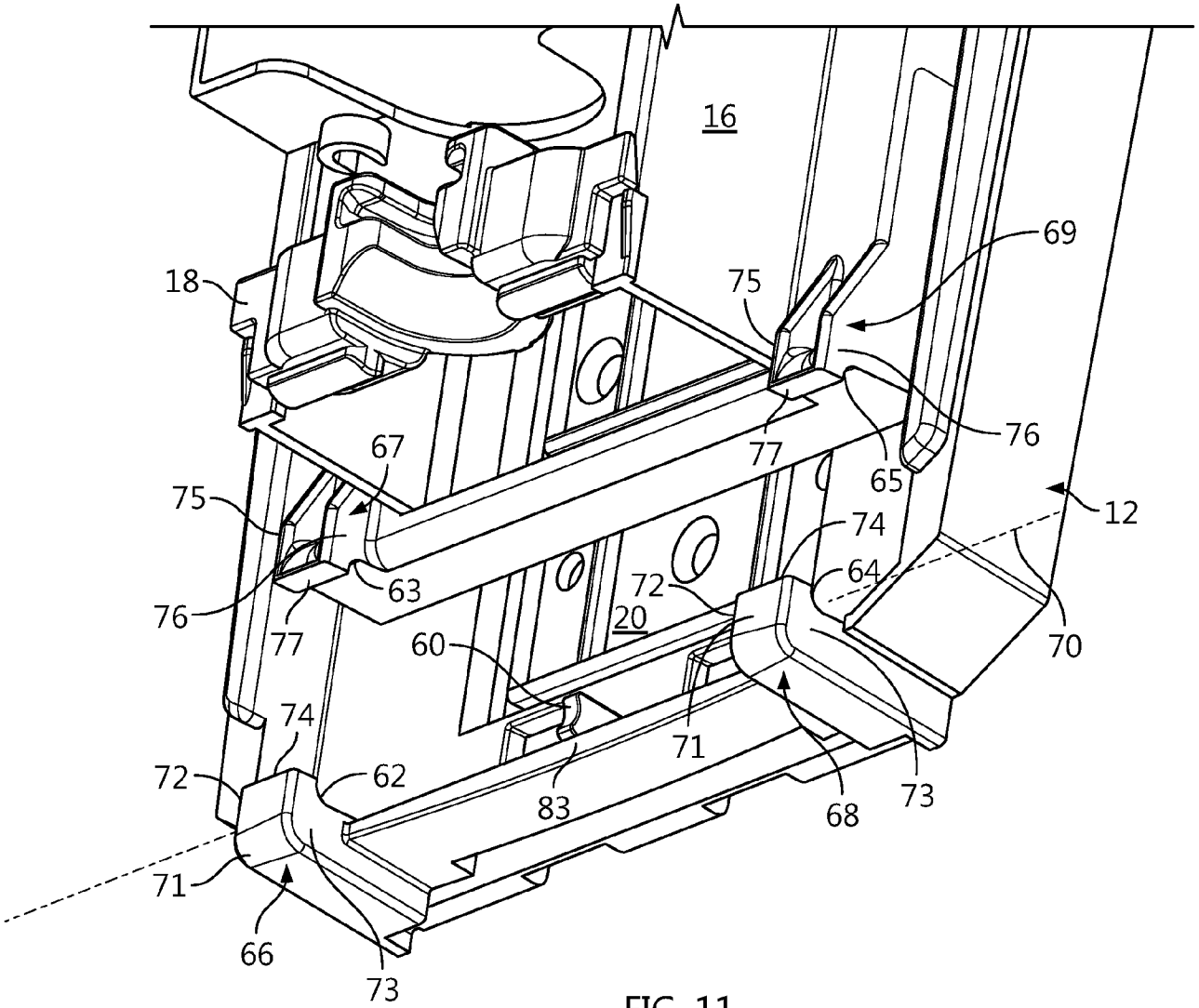
FIG. 11 is an enlarged view of lower portions of FIG. 10.

FIGS. 8 and 9 illustrate the backplate 12 secured to the wall plate 20 with the support member 16 in the lower first position in a locked condition. FIGS. 10 and 11 illustrate the support flange 16 in a raised second position above the lower first position shown in FIGS. 8 and 9. As can best be seen in the enlarged view of FIG. 11, the backplate 12 carries a first journal bearing portion comprising a center bearing surface 60, a lower left bearing surface 62 and a lower right bearing surface 64 which surfaces are cylindrical about a common journal axis 70. The support member 16 carries a second journal bearing comprising an upper left bearing surface 63 and upper right bearing surface 65 which are cylindrical and are disposed about the journal axis 70 when the support member 16 is in the lower first position and locked condition on the backplate 12 as seen in FIG. 9.

The backplate 12 includes a lower left support arm 66 and a lower right support arm 68, each of which extends forwardly from the backplate 12 to a respective distal end 71. Each of the lower support arm 66 and the lower right support arm 68 has a vertically disposed left side 72 and a vertically disposed right side 73. Each of the lower left bearing surface 62 and the lower right bearing surface 64 extend laterally across their respective lower left support arm 66 and lower right support arm 68 between the respective left side 72 and the right side 73 and each merges at an upward forward end into an upper shoulder 74 directed upwardly.

The support member 16 carries an upper left support arm 67 and an upper right support arm 69, each of which extends forwardly from the support member 16 and similarly have a vertically extending left side 75 and a vertically extending right side 76. The upper left bearing surface 63 and the upper right bearing surface 65 are carried on each of the upper left support arm 67 and the upper right support arm 69 respectively extending between the left side 75 and the right side 76 and merging at a lower front end into a lower shoulder 77.

As best seen in FIG. 9, with the support member 16 is in the lower first position: the upper shoulder 74 of the lower support arms 66 and 68 are in close proximity to the lower shoulder 77 of the upper support arms 67 and 69; the lower left bearing surface 62 is disposed to be opposed to and coaxial with the upper right bearing surface 63; and about the journal axis 70, the lower right bearing surface 64 is shown to be opposed to and coaxial with the upper right bearing surface 65 about the journal axis 70. As seen in FIG. 9, the first journal bearing portion on the backplate 12 comprising the surfaces 60, 62 and 64 and the second journal bearing portion on the support member 16 comprising the surfaces 63 and 65 define a journal bearing coaxially about the journal axis 70 having a bore 78 coaxial about the journal axis 70 for receiving and journaling therein the journal rod 30 of the cover member 14.

The center bearing surface 60 presents a concave surface forming a portion of a cylindrical of a diameter equal to the diameter of the cylindrical central rod portion 32 of the journal rod 30 and adapted to engage the central rod portion 32 of the journal rod 30. The cylindrical left rod portion 34 and the cylindrical right rod portion 35 of the journal rod 30 have the same diameter. Each of the lower left bearing surface 62, the lower right bearing surface 64, the upper left bearing surface 63 and the upper right bearing surface 65 carry concave surfaces which are cylindrical with a diameter corresponding to the diameter of the left rod portion 34 and the right rod portion 35. The axial dimension of each of the support arms 66 and 67 as measured along the journal axis 70 between their respective left sides and right sides is selected to be marginally less than the axial length of the left rod portion 34. Similarly, the axial dimension of each of the support arms 68 and 69 as measured along the journal axis 70 between their respective left sides and right sides is selected to be marginally less than the axial length of the right rod portion 35.

Figure 14:
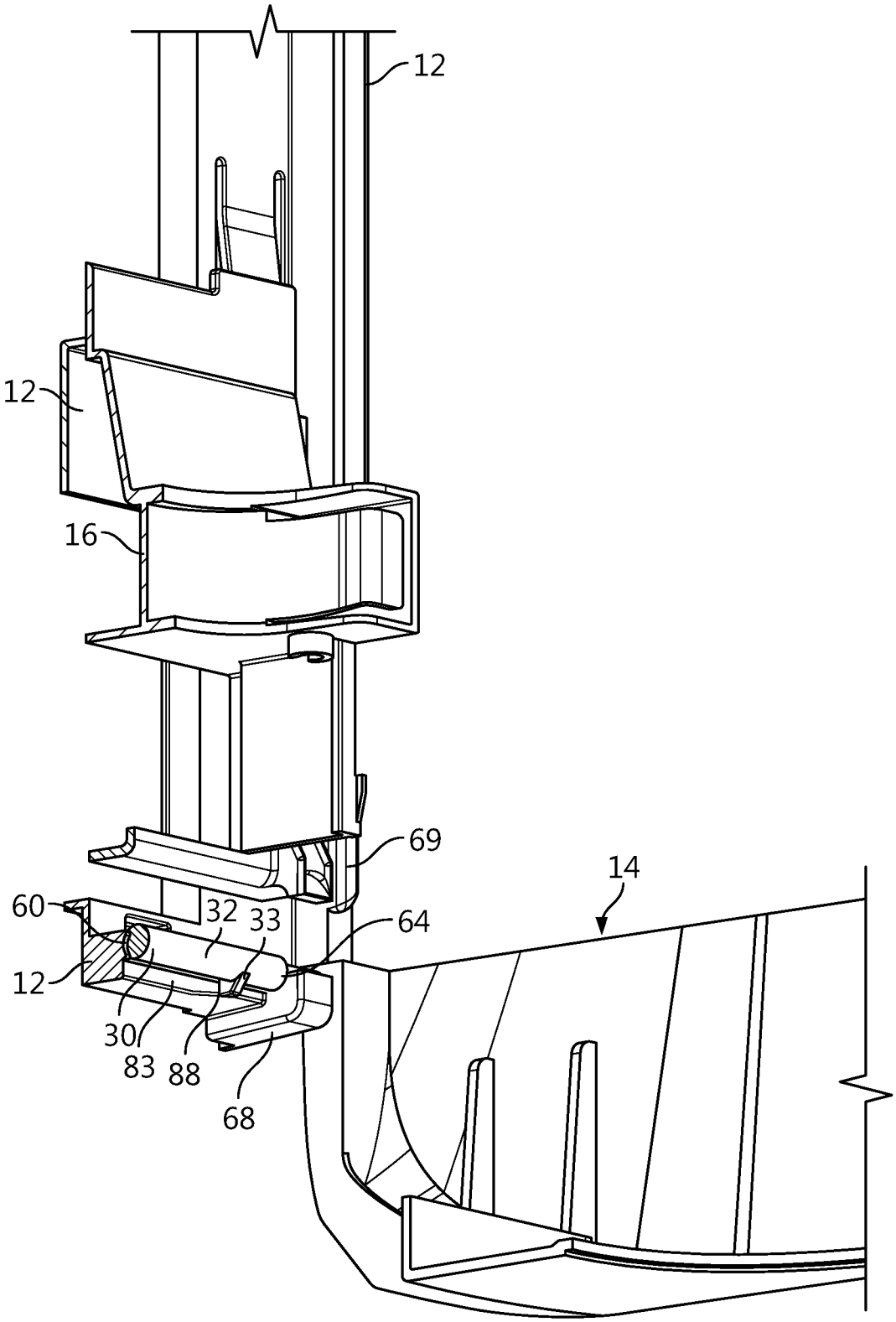
FIG. 14 is a view the same as FIG. 13, however, with the support member in an upper second position.

As can be seen in FIGS. 11 and 14, below the center bearing surface 60, the backplate member 12 carries a forwardly directed stop surface 83.

Figure 15:
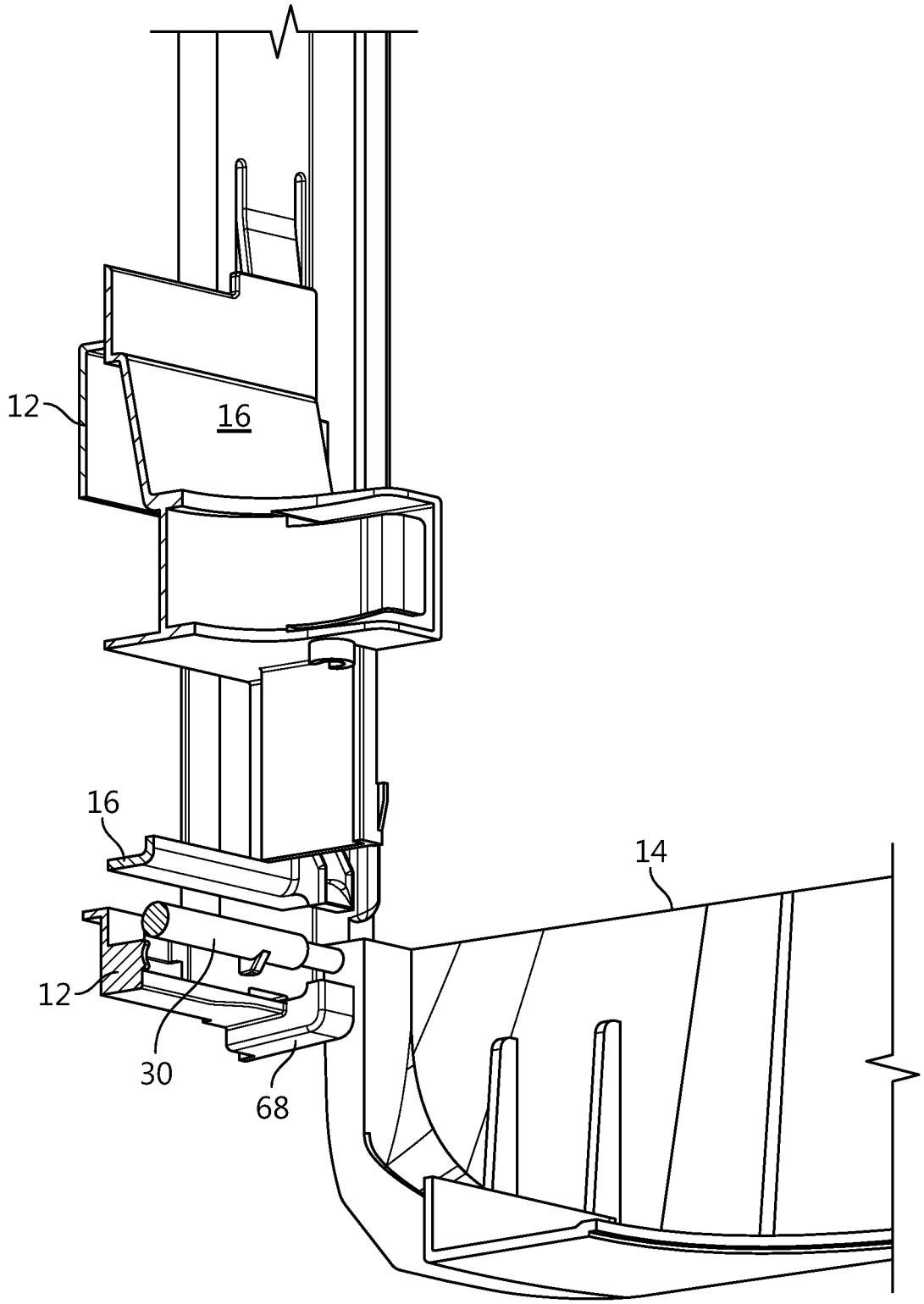
FIG. 15 is a view the same as FIG. 14, however, with the cover member in a position vertically above the position of the cover member in FIG. 14.
Figure 16:
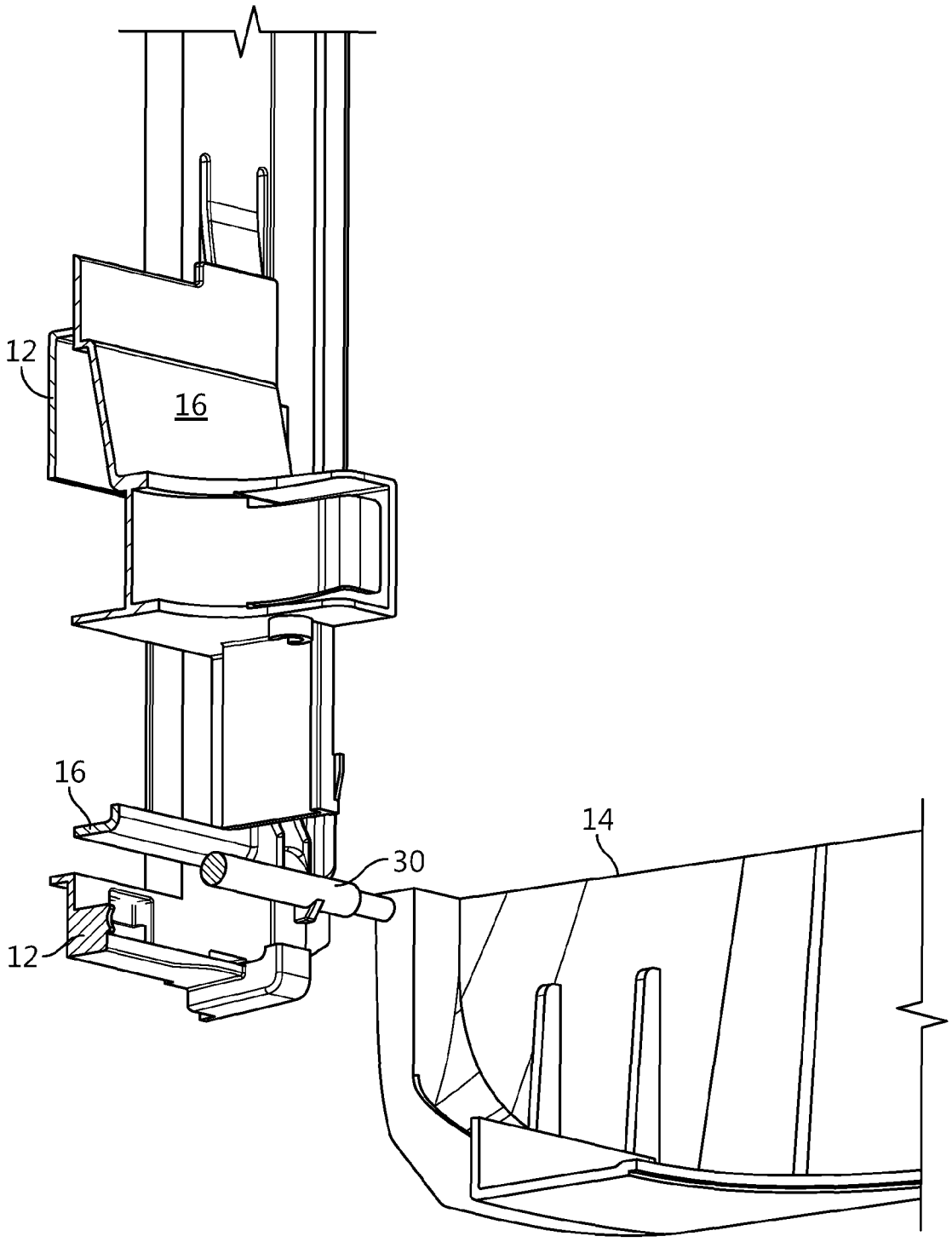
FIG. 16 is a view the same as FIG. 15, however, with the cover member in a position horizontally forwardly of the position of the cover member in FIG. 15.
Figure 17:
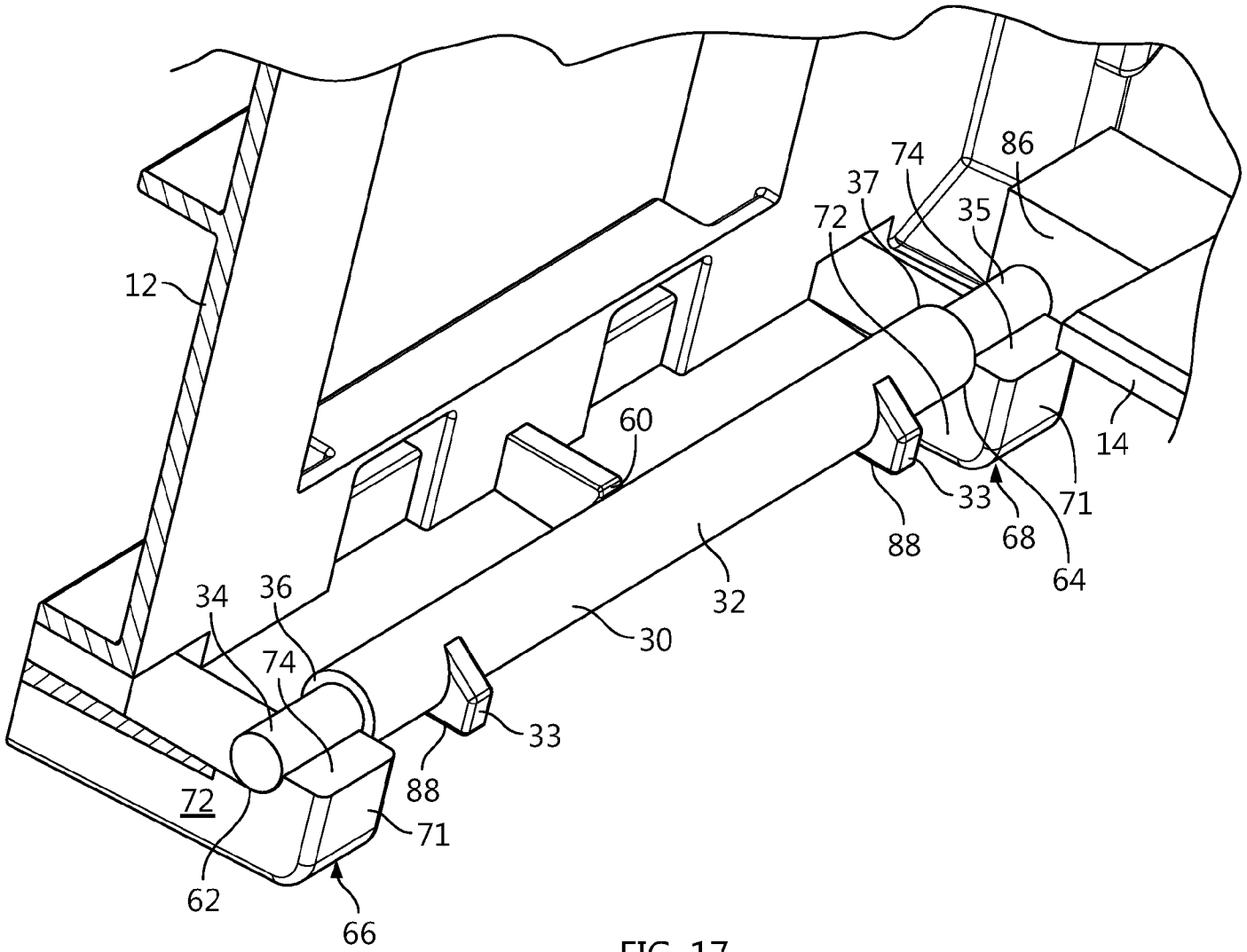
FIG. 17 is a partial pictorial view of the backplate and the cover member as cross-sectioned through a vertical plane immediately to the left of a lower left support arm on the backplate as seen from the left-hand side and with the cover member in an open position as in FIG. 1.

Reference is made to FIGS. 7 and 16 which illustrate a condition in which the cover member 14 is disengaged from the backplate 12 ready for coupling with the backplate 12. As seen in FIGS. 7 and 16, the cover member 14 is shown with its journal rod 30 disposed horizontally forwardly in front of the backplate 12. From the position of FIGS. 7 and 16, the cover member 14 is moved horizontally rearwardly to the position of FIG. 15 with the journal rod 30 moved rearwardly to be above the lower support arms 66 and 68 and below the upper support arms 67 and 69. From the position of FIG. 15, the cover member 14 is moved vertically downwardly such that the journal rod 30 becomes engaged with the backplate 12 as shown in FIGS. 6 and 14 assuming what is referred to as an "open engaged position". In the open engaged position of FIGS. 6 and 14: the center bearing surface 60 engages the central portion 32 of the journal rod 30 at a rear of the journal rod 30; the lower left bearing surface 62 engages the left rod portion 34 and the lower right bearing surface 64 engages the right rod portion 35. On the left side, the lower left support arm 66 is received between the outwardly directed left shoulder 36 of the journal rod 30 and a laterally inwardly directed shoulder 85 carried on the left side wall 25 of the cover member 14, with the laterally inwardly directed right side 73 of the lower left support arm 66 in opposition to the left shoulder 36 of the journal rod 30 and the left side 72 of the lower left support arm 66 in opposition to the shoulder 85 of the left side 25 of the cover member 14 thereby limiting relative axial sliding of the journal rod 30 and therefore the cover member 14 relative to the backplate 12. Similarly, on the right side, the lower right support arm 68 is disposed between the right shoulder 37 of the journal rod 30 and a laterally inwardly directed shoulder surface 86 on the right side 26 of the cover member 14 with the right side 73 of the lower right support arm 68 in opposition to the shoulder surface 86 and the left side 72 of the lower right support arm 68 in opposition to the right shoulder 37 to limit relative axial movement.

Figure 12:
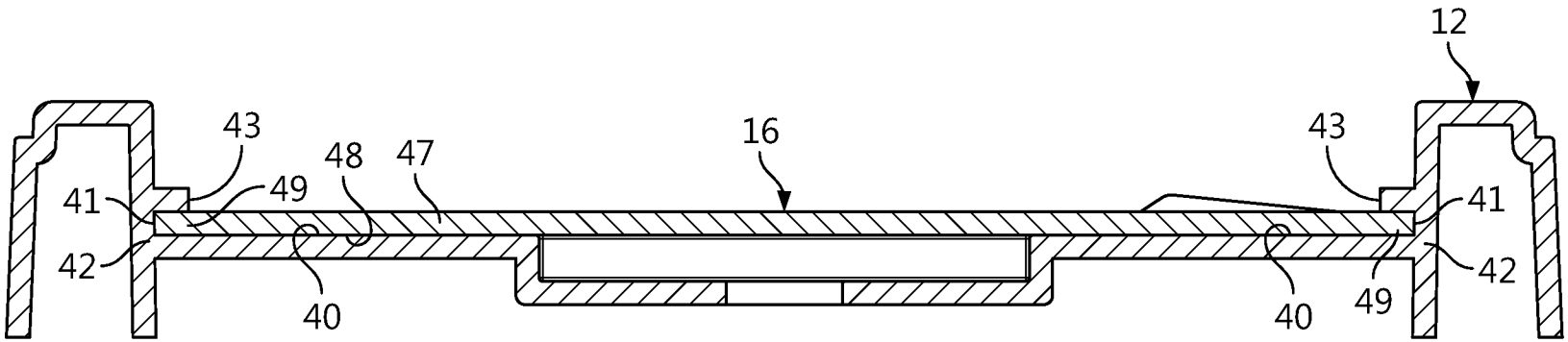
FIG. 12 is a horizontal top cross-sectional view through the backplate and the support member along section line A-A' in FIG. 5.

As can best be seen in FIG. 14, each of the stop lugs 33 carried on the journal rod 30 include a lug stop shoulder 88 which, when the cover is in the open position as shown in FIG. 12, engages the stop surface 83 provided on the backplate member 12 to stop rotation of the cover member 14 about the journal axis 70 at the open position.

With the cover 14 in the open engaged position on the backplate 12 as shown in FIGS. 6 and 14, the support member 16 is moved from the raised second position shown in FIGS. 6 and 14 to assume the lower first position and locked condition on the backplate 12 to lock the journal rod 30 to the backplate 12 against removal journalled for rotation with the rod axis 31 coincident with the journal axis 70 as seen in FIGS. 5 and 13.

In the condition of FIGS. 5 and 13: the upper left bearing surface 63 engages the left rod portion 34 and the upper right bearing surface 65 engages the right rod portion 35; the upper left support arm 67 is disposed between the shoulder 85 and the left shoulder 36 on the journal rod 30; the upper right support arm 69 is disposed between the shoulder 86 and the right shoulder 37 on the journal rod 30; and the journal rod 30 is secured between the bearing surfaces 60, 62, 63, 64 and 65 journalled about the journal axis 70 against removal. The support member 16 is locked to the backplate 12 by reason of the operation of the catch members 53. The journal rod 30 secures the cover member 14 to the backplate 12 locating the cover member 14 for pivoting axially relative to the journal axis 70 of the backplate 12.

Removal of the cover member 14 from the locked condition of FIG. 13 is accomplished by firstly engaging the catch members 53 and sliding the support member 16 from the lower first position of FIG. 13 to the upper second position as shown in FIG. 14; secondly, moving the cover member 14 from the position of FIG. 14 vertically upwardly to the position of FIG. 15 and then, thirdly, moving the cover member 14 horizontally forwardly from the position of FIG. 15 to the position of FIG. 16.

In accordance with the present invention, the cover member 14 is adapted to be engaged and removed from engagement with the backplate 12 as for replacement by another cover member 14 which other replacement cover member 14 may be the same or be different. For example, different cover members 14 while having substantially the same journal rod 30 may have different external appearances, profiles, internal volumes, size, shape and spacing of window members 13 and size, spacing, appearance and configuration of the lever 15. Different cover members 14 may eliminate the window member 13 and/or lever 15.

In the preferred embodiment as illustrated, in the open engaged position illustrated in FIGS. 6 and 14 with the cover member 14 in an open position relative to the backplate 12, the cover member 14 is supported on the backplate 12 by engagement between the cover member 14 and the backplate 12 alone. This may preferably be accomplished by, having regard to the engagement of the lug stop shoulder 88 with the stop surface 83, providing the central bearing surface 60 to extend circumferentially about the axle rod 30 a sufficient angular extent that the central bearing surface 60 together with the lower left bearing surface 62 and the lower right bearing surface 64, sufficiently engage the journal rod 30 to overcome forces which may arise when the cover member 14 is in the position shown in FIG. 14 which may tend to urge the journal rod 30 out of engagement with the bearing surfaces 60, 62 and 64. For example, the outer bearing surface 60 may extend circumferentially to an extent that in moving the journal rod 30 from the position of FIG. 15 to the position of FIG. 14, the journal rod 30 is received in a snap-fit against removal between the central bearing surface 60 on one hand and the left and right lower bearing surfaces 62 and 64 on the other hand. Having the cover member 14 supported merely by the backplate 12 in the open engaged position shown in FIG. 14 can be advantageous, for example, to facilitate a user placing the cover member 14 in the position of FIG. 14 and then manipulating the support member 16 with both hands. This is not necessary since, for example, with one hand holding the cover member 14 in a position as shown in FIG. 12, the user's other hand may be used to move the support member 16 from an upper second position downwardly to a lower first position.

In accordance with the present invention, the support member 16 and the catch members 53 of the backplate 12 preferably interact such that when the support member 16 is raised to the upper second position as shown, for example, in FIGS. 14 and 6, the catch members 53 under their inherent bias engage rearwardly directed portions of the support member 16 to hold the support member 16 in the raised second position relative the backplate 12 against downward movement until downwardly directed forces are manually applied to the support member 16.

Referring to FIGS. 4 and 5, the cover member 14 carries at its upper rear a rearwardly extending lock tab 100 for engagement with a lock latch 101 at the upper rear of the backplate 12 to releasably lock the cover in a closed position as shown in FIG. 1. Release of the lock latch 101 is provided for by various manners including engagement of a tool in an access opening 102 at the upper top of the backplate 12.

Figure 20:
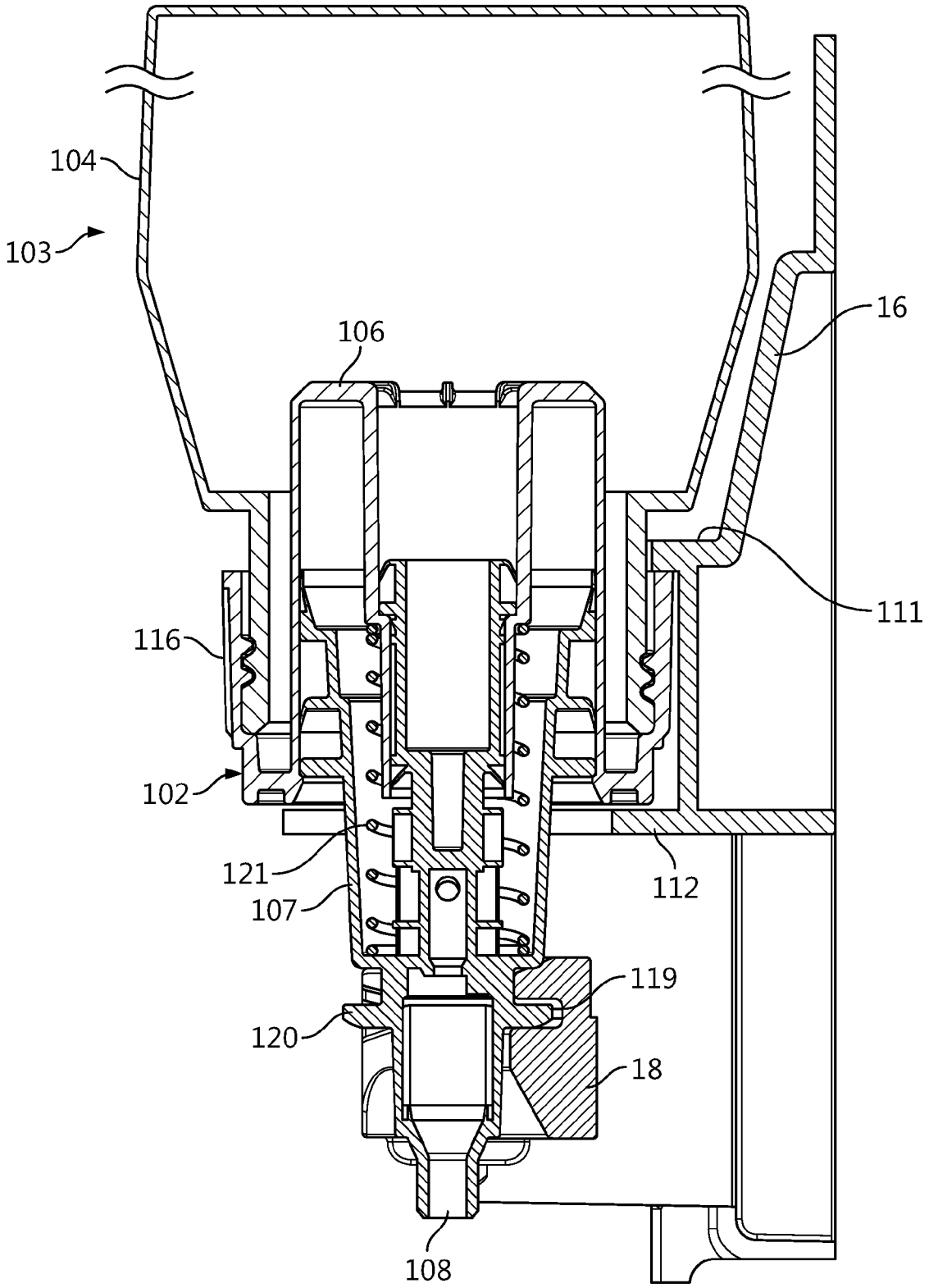
FIG. 20 is a vertical cross-sectional side view through FIG. 18 along the center axis of the pump assembly and additionally schematically showing a reservoir bottle.

As schematically illustrated in FIG. 20, a removable reservoir assembly 103 is for use with the dispenser 10. The reservoir assembly 103 includes a reservoir bottle 104 and a pump assembly 102. The pump assembly 102 is secured about an open neck of the reservoir bottle 104 for dispensing fluid downwardly out a discharge outlet 108. The pump assembly 102 is schematically illustrated to include a piston chamber-forming member 106 fixedly secured to the bottle 104 and a piston element 107 reciprocally removable in a cycle of operation relative to the piston chamber-forming member 106 to discharge fluid from the reservoir bottle 104 out downwardly directed discharge outlet 108.

Figure 19:
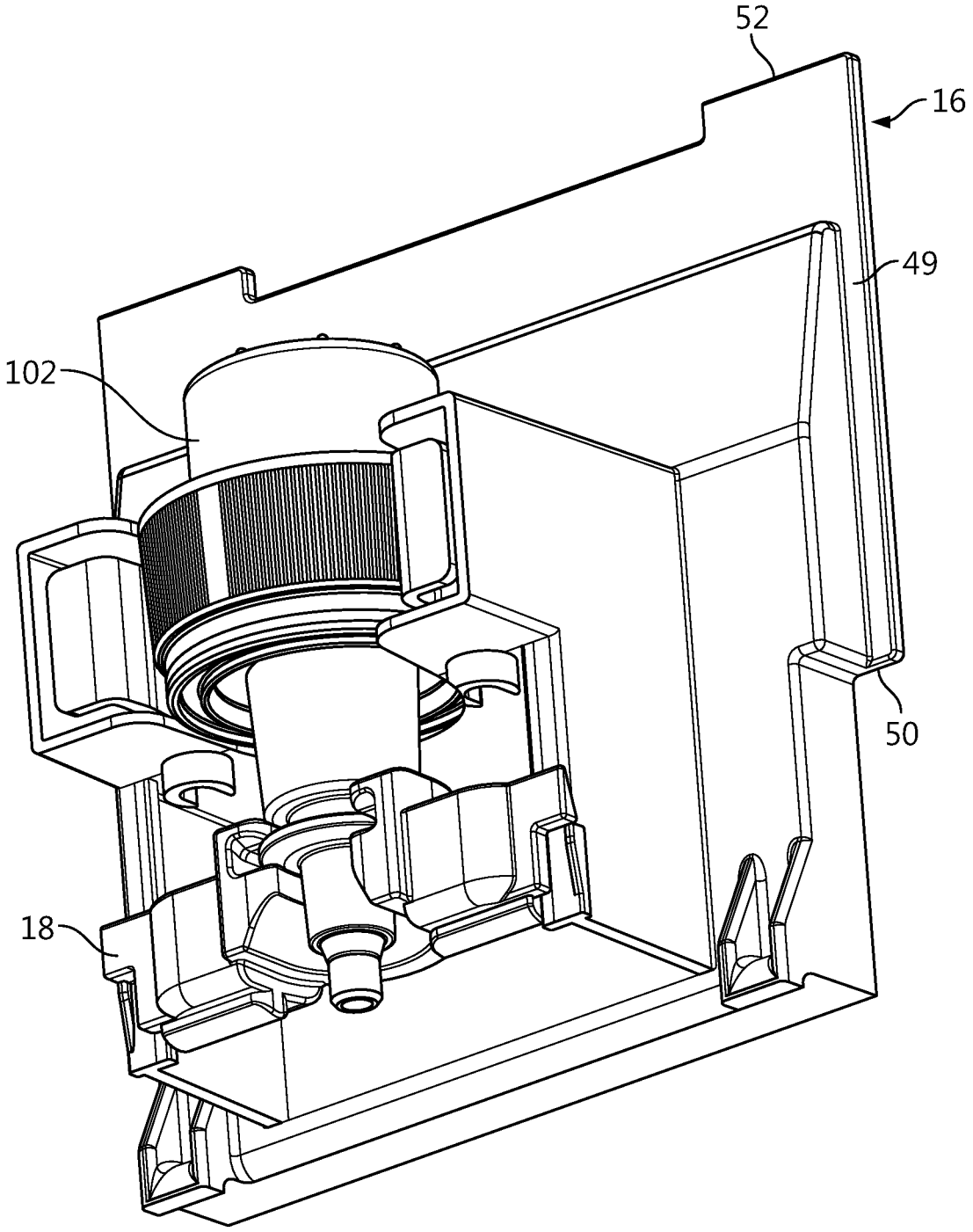
FIG. 19 is a schematic pictorial view the same as FIG. 18 but showing the pump assembly engaged with the support member and actuator plate.

Referring to FIGS. 18, 19 and 20, the support member 16 carries a bottle holding mechanism 110 for engagement and disengagement of the pump assembly 102 of the reservoir assembly 103. The bottle holding mechanism 110 includes a horizontal upper support plate 111 and a horizontal lower support plate 112 spaced vertically from the upper support plate 111. A left spring arm 113 and a right spring arm 114 are provided therebetween. The plates 111 and 112 are on either side of a forwardly opening slotway 115. The bottle reservoir assembly 103 may be slid rearwardly relative to the support member 16 to place a cylindrical annular flange 116 of the piston chamber-forming member 106 into the slotway 115 securely removably coupled to the support member 16 between the plates 111 and 112 engaged between the spring arms 113 and 114.

Figure 21:
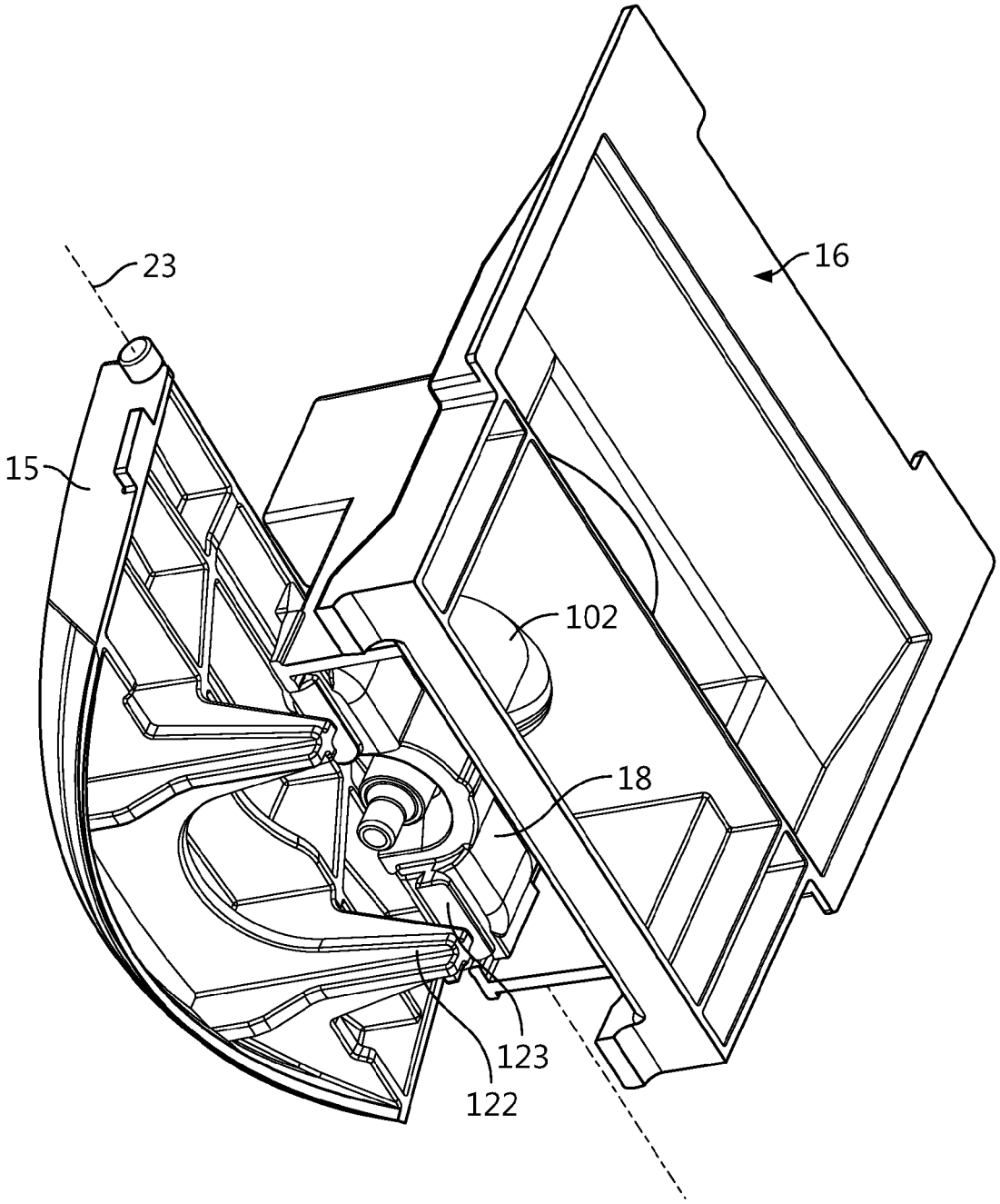
FIG. 21 is a schematic rear pictorial view of the assembly shown in FIG. 19 in conjunction with a lever positioned as if carried on an assembled dispenser as in FIG. 1.

The actuator member 18 is mounted on vertical side plates 117 and 118 of the bottle engagement mechanism 110 for vertical sliding. The actuator member 18 includes an engagement slot 119 for engagement of an engagement flange 120 carried on the piston-forming element 107 such that vertical movement of the actuator member 18 moves the piston-forming element 107 to dispense fluid. As seen in FIG. 20, an internal spring 121 within the pump assembly 102 biases the piston-forming element 107 and hence the actuator member 18 downwardly to a fully extended position. As can be best seen in FIG. 21 showing the relative location of the pump assembly 102, the support member 16, the actuator plate 18 and the lever 15 in an assembled dispenser 10 with rotation of the lever 15 about the axis 23, rearwardly extending actuator arm 122 on the lever 15 engage downwardly directed surfaces 123 on the actuator member 18 to move the actuator member 18 upwardly against the bias of the spring 121 to dispense fluid.

Figure 22:
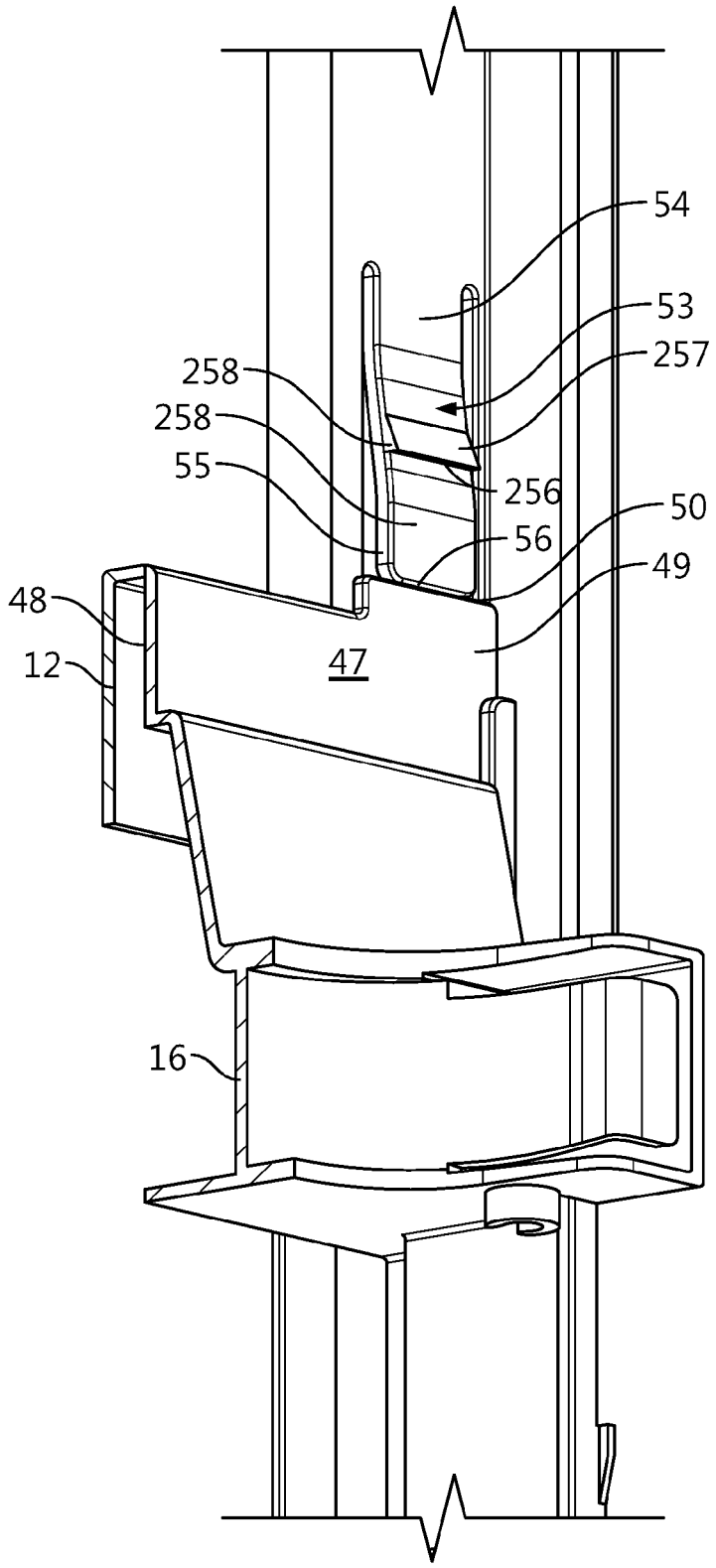
FIG. 22 is an enlarged pictorial view of a portion of FIG. 13 showing a modified catch member.
Figure 23:
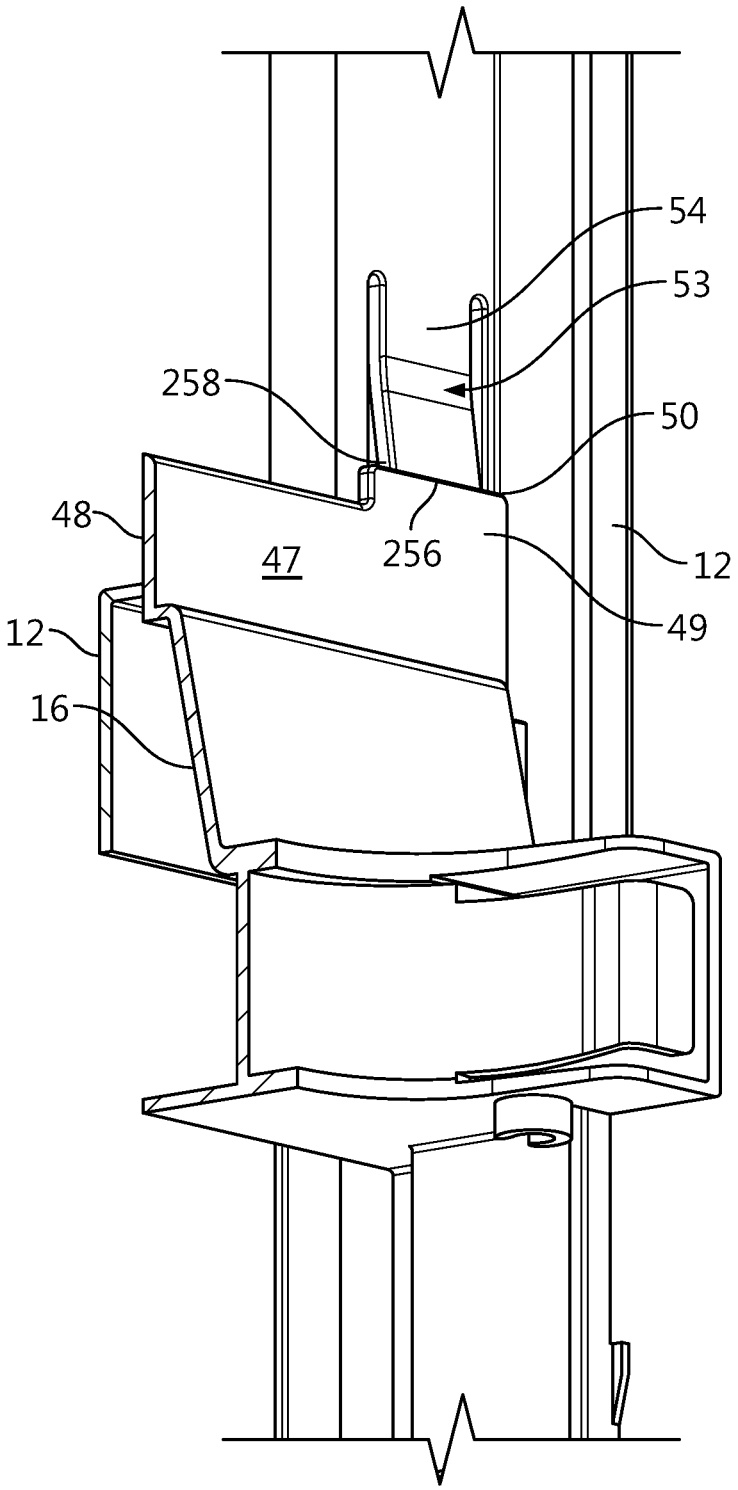
FIG. 23 is the same as FIG. 22 but showing the relative position of the support member on the back member as in FIG. 14.

Reference is made to FIGS. 22 and 23 which illustrate the backplate 12 and the support member 16 in the same positions as shown in FIGS. 13 and 14, respectively, and with FIGS. 22 and 23 being identical but for the modification of the catch member 53 to provide intermediate at its upper end 54 and its distal catch end 55 a downwardly facing intermediate stop shoulder 256. The downwardly facing intermediate stop shoulder 256 is provided as the downwardly directed face of a forwardly extending intermediate ramp-like stop member 258 having a bevelled upwardly and rearwardly directed surface 257. In use, with the support member 16 in the lower, first position as shown in FIG. 22, the shoulder 56 at the distal catch end 55 engages the stop shoulder 50 of the slide member 47 to prevent upward movement of the slide member 47. To move the slide member 47 upwardly from the locked position shown in FIG. 22, the catch member 53 is manually depressed rearwardly such that the distal end 55 is rearward of the stop shoulder 50 whereupon the support member may be slid vertically upwardly. Once the stop shoulder 50 of the support member 16 is above and in front of the shoulder 56, the catch member 53 is to be released to act under its own bias and the support member 16 may then be slid upwardly along the forward surface of the catch member 53 until the stop shoulder 50 engages the intermediate stop shoulder 256 as seen in FIG. 23 and in which position of FIG. 23 as is the case with FIG. 14, the support member 16 has been moved to an upper second position sufficient that the cover 14 may be applied to or removed from the backplate 12.

To remove the cover member 14 from engagement with the backplate 12 from the position of FIG. 23, the catch member 53 is manually urged rearwardly such that the intermediate stop shoulder 56 is rearward of the stop shoulder 50.

Preferably, in the position as illustrated in FIG. 23, the forward surface 258 urged under the inherent bias of the catch member 53 into the rear surface 48 of the slide member 47 downwardly from the stop shoulders 50 to frictionally engage the support members 16 and hold it in the upper second position shown in FIG. 23.

The provision of the support member 16 to be removable and replaceable by other support members 16 is advantageous. A replacement support member may comprise an identical support member 16 or may comprise a support member having different characteristics as, for example, carrying a different bottle engagement mechanism 110 and/or a different engagement plates 111 and 112 as may be adapted for coupling and uncoupling of different reservoir assemblies, bottles, pump assemblies, piston chamber-forming members and piston-forming elements. For example, the support member 16 shown in the preferred embodiment could be replaced by a support member having a different configuration as, for example, to adopt an arrangement for coupling and uncoupling of a reservoir assembly having a configuration similar to that disclosed in U.S. Pat. No. 8,413,852 to Ophardt et al, issued Apr. 9, 2013, the disclosure of which is incorporated herein by reference. Similarly, the support member 16 could be modified so as to provide a bottle engagement mechanism for automated dispensing of fluid having a configuration and arrangement as disclosed in U.S. Pat. No. 5,836,482 to Ophardt et al, issued Nov. 17, 1998, the disclosure of which is incorporated herein by reference. The support member 16 can, for example, in adopting the arrangement of U.S. Pat. No. 5,836,482 carry a module incorporating the motor activation mechanism, batteries and the like. Insofar as the particular nature of the reservoir assembly changes by the use of a replacement reservoir assembly, a suitably appropriate complementary replacement cover member 14 may be provided, for example, to provide a modified lever or in the case of an automated dispenser, no lever.

It is within the scope of the present invention that the support member 16 may also carry the pump assembly and that in use, the pump assembly remains with the support member 16 and merely the bottle is replaced after the bottle may be emptied. The nature of the pump assembly which may be used in accordance with the present invention is not limited to piston pumps and a wide variety of different pump assemblies may be used.

The preferred embodiments of FIGS. 1 and 2 show the cover 14 as coupled at its rear bottom for coupling to the backplate 12 at the lower front of the backplate 12. It is to be appreciated that a cover 14 could also be similarly coupled to the backplate at the upper rear of the cover.

In the preferred embodiments, a cavity 150 is defined between the cover 14 and the backplate 12 within which a reservoir assembly 103 is provided in the form of a bottle containing a consumable fluid to be dispensed. The reservoir assembly 103 forms a type of cartridge which is adapted to be coupled to the support member 16 within the cavity. In accordance with the invention, various other types of consumable products may be dispensed as, for example, including paper towels for drying a person's hands which may be carried on a cartridge removably secured to the support member 16 within the housing and for dispensing as, for example, through the cover.

While the invention has been made with reference to preferred embodiments of the present invention, many modifications and variations will occur to persons skilled in the art. For a definition of the invention, reference is made to the following claims.

We claim:

1. A dispenser for a consumable product having a backplate for mounting to a wall and a cover member pivotably mounted to the backplate for relative movement between a closed position and an open position;

the backplate having an upper end and a lower end, the cover member having an upper end and a lower end, the cover member carrying a journal rod proximate a lower end of the cover disposed about an axis;

a movable member coupled to the backplate for relative vertical sliding movement between a first position and a second position, the movable member having an upper end and a lower end, the backplate carrying at the lower end of the backplate a first journal bearing portion disposed about a horizontal axis orientated when the backplate is mounted vertically with the first portion of the journal bearing portion open upwardly, the movable member carrying a second journal bearing portion complementary to the first journal bearing portion proximate the lower end of the movable member vertically above the first journal bearing portion with the second journal bearing portion open downwardly opposed to the first journal bearing portion;

the second bearing portion slidable vertically upwardly away from the first bearing portion in sliding movement of the support member from the first position to the second position, with the movable member in the first position:

a. the first journal portion and the second journal portion mate with each other to form a journal bearing with a bore for receiving therein the journal rod, b. when the journal rod is received in the bore, the bore prevents removal of the journal rod from the bore, and c. when the journal rod is received in the bore, the bore engages the journal rod for pivoting of the cover member about the axis relative the backplate between the open position and the closed position;

with the support member in the second position the first journal portion and the second journal portion are spaced from each other:

a. to permit the journal rod to be inserted into the journal bore to engage the cover member with the backplate, and b. to permit the journal rod to be removed from the journal bore permitting the cover member to disengage from the backplate.

2. A dispenser as claimed in claim 1 comprising a fluid dispenser in which the consumable product is a fluid.

3. A dispenser as claimed in claim 1 wherein:

with the movable member in the second position and with the journal rod in engagement with the first journal portion of the backplate, the movable member can be moved to slide vertically downward from the second position to the first position to engage the journal rod in the bore.

4. A dispenser as claimed in claim 3 wherein with the movable member in the second position, with the journal rod in engagement with the first journal portion of the backplate, the backplate supports the cover member on the backplate in the open position.

5. A dispenser as claimed in claim 4 wherein, in the open position, the cover member is supported by the backplate cantilevered forwardly from the lower end of the backplate.

6. A dispenser as claimed in claim 5 wherein the lower end of the backplate carries a stop surface and the lower end of the cover member carries a stop shoulder located in opposition to the stop shoulder on the backplate to engage the stop surface on the backplate to limit rotation of the cover member from the closed position toward the open position in the open position.

7. A dispenser as claimed in claim 6 wherein, in the open position, the cover member extends horizontally forwardly from the backplate supported by the backplate cantilevered forwardly from the lower end of the cover member and the lower end backplate.

8. A dispenser as claimed in claim 3 wherein:

a first of the backplate and the movable member carries a vertically extending guide channel, a second of the backplate and the movable member carries a slide member vertically slidably engaged in the guide channel, the slide member removable from and insertable into the guide channel for respective disengagement and engagement of the movable member from the backplate.

9. A dispenser as claimed in claim 3 including a releasable latch to lock the movable member in the first position, the latch being releasable to move the movable member between the first position and the second position.

10. A dispenser as claimed in claim 9 wherein on sliding the movable member from the first position to the second position the latch locks the movable member in the first position.

11. A dispenser as claimed in claim 10 including a releasable catch mechanism to hold the movable member in the second position when moved to the second position, the catch mechanism on sliding of the movable member from the first position to the second first position holds the movable member in the second position, the catch mechanism being releasable to move the movable member from the second position and the first position.

12. A dispenser as claimed in claim 3 including a releasable catch mechanism to hold the movable member in the second position when moved to the second position, the catch mechanism on sliding of the movable member from the first position to the second first position holds the movable member in the second position, the catch mechanism being releasable to move the movable member from the second position and the first position.

13. A dispenser as claimed in claim 1, wherein the consumable product is a fluid:

the movable member comprises a support member adapted to support a first cartridge selected from the group consisting of:

a. a reservoir containing fluid to be dispensed, b. a pump for dispensing fluid, and c. a replaceable unit comprising a reservoir containing fluid to be dispensed and a pump to dispense fluid from the reservoir.

14. A dispenser as claimed in claim 13 wherein:

the support member is removable from the back plate for replacement by a similar support member adapted to support a second cartridge selected from the group consisting of:

a. a reservoir containing fluid to be dispensed, b. a pump for dispensing fluid, and c. a replaceable unit comprising a reservoir containing fluid to be dispensed and a pump to dispense fluid from the reservoir.

15. A dispenser as claimed in claim 13 including:

a releasable latch to lock the support member in the first position, the latch being releasable to move the support member between the first position and the second position, a release member is provided for manual engagement to unlock the latch, removal of the first cartridge from the support ember being required to manually engage the release lever to unlock the latch.

16. A dispenser as claimed in claim 3 wherein, in the closed position, the upper end of the cover extends upward from the lower end of the backplate locating the upper end of the cover member engaged with the upper end of the backplate above the lower end of the cover member, and in the open position, the upper end of the cover extends forwardly from the lower end of the backplate locating the upper end of the cover member forward of the lower end of the cover member.

17. A dispenser as claimed in claim 16 wherein the cover has two side panels and a front panel, the journal rod extending horizontally between the side panels of the cover member rearward of the front panel, in the closed position an interior cavity defined between the cover and the backplate, with the cover member in the closed position, the support member and the element are disposed within the cavity.

18. A dispenser as claimed in claim 16 wherein, in the open position, the cover member is supported by the backplate cantilevered forwardly from the lower end of the backplate.

19. A dispenser as claimed in claim 18 wherein the lower end of the backplate carries a stop surface and the lower end of the cover member carries a stop shoulder located in opposition to the stop shoulder on the backplate to engage the stop surface on the backplate to limit rotation of the cover member from the closed position toward the open position in the open position.

20. A dispenser as claimed in claim 19 including a stop lug extending radially from the journal rod, the stop shoulder is provided on the stop lug.

* * * * *